US010875313B2

(12) United States Patent
Fukunaga et al.

(10) Patent No.: US 10,875,313 B2
(45) Date of Patent: Dec. 29, 2020

(54) WIPE UNIT AND INK-JET RECORDING APPARATUS INCLUDING THE SAME

(71) Applicant: Kyocera Document Solutions Inc., Osaka (JP)

(72) Inventors: Yasuyuki Fukunaga, Osaka (JP); Masaki Murashima, Osaka (JP)

(73) Assignee: Kyocera Document Solutions Inc., Osaka (JP)

( * ) Notice: Subject to any disclaimer, the term of this patent is extended or adjusted under 35 U.S.C. 154(b) by 0 days.

(21) Appl. No.: 16/365,702

(22) Filed: Mar. 27, 2019

(65) Prior Publication Data

US 2019/0299618 A1 Oct. 3, 2019

(30) Foreign Application Priority Data

Mar. 29, 2018 (JP) ..... 2018-065169

(51) Int. Cl.
*B41J 2/165* (2006.01)
*B41J 2/185* (2006.01)

(52) U.S. Cl.
CPC ..... *B41J 2/16547* (2013.01); *B41J 2/16508* (2013.01); *B41J 2/185* (2013.01); *B41J 2002/1856* (2013.01)

(58) Field of Classification Search
CPC .... B41J 2/16547; B41J 2/16508; B41J 2/185; B41J 2002/1856; B41J 2/16585; B41J 29/02; B41J 2/16511; B41J 2/16544; B41J 2/16538
See application file for complete search history.

(56) References Cited

U.S. PATENT DOCUMENTS

2009/0201334 A1* 8/2009 Hasegawa ..... B41J 2/16508 347/29
2014/0374631 A1* 12/2014 Sherrit ..... F15D 1/025 251/118
2016/0046128 A1* 2/2016 Tanda ..... B41J 2/16544 347/33
2016/0185121 A1* 6/2016 Somete ..... B41J 2/16535 347/33

FOREIGN PATENT DOCUMENTS

JP 2007-216466 A 8/2007

* cited by examiner

*Primary Examiner* — Sharon A. Polk
(74) *Attorney, Agent, or Firm* — James Judge

(57) ABSTRACT

A wipe unit cleans a recording head having an ink discharge surface on which an ink discharge opening that discharges an ink onto a recording medium opens. The wipe unit includes a wiper and a collecting tray. The wiper wipes off an ink forcibly extruded from the ink discharge opening. The collecting tray is arranged under the wiper. The collecting tray collects the ink wiped off with the wiper. The collecting tray includes a discharge port and a plurality of ribs. The discharge port discharges the collected ink downward, and the plurality of ribs are arranged so as to surround a peripheral area of the discharge port and arranged with a predetermined interval from one another in a circumferential direction of the discharge port.

6 Claims, 21 Drawing Sheets

WIPE UNIT AND INK-JET RECORDING APPARATUS INCLUDING THE SAME

INCORPORATION BY REFERENCE

This application is based upon, and claims the benefit of priority from, corresponding Japanese Patent Application No. 2018-065169 filed in the Japan Patent Office on Mar. 29, 2018, the entire contents of which are incorporated herein by reference.

BACKGROUND

Unless otherwise indicated herein, the description in this section is not prior art to the claims in this application and is not admitted to be prior art by inclusion in this section.

As a recording apparatus such as a facsimile, a copier, and a printer, an ink-jet recording apparatus that forms an image by discharging an ink is widely used for a reason that it can form a high-resolution image.

A typical ink-jet recording apparatus generally performs a recovery process that forcibly extrudes an ink having increased viscosity in an ink discharge opening from an ink discharge opening and wipes off the ink with a wiper. In view of this, the ink-jet recording apparatus includes a recording head that discharges the ink onto a paper sheet (recording medium) and a wipe unit that cleans the recording head.

The wipe unit includes a wiper and a collecting tray. The wiper wipes off the forcibly extruded ink. The collecting tray is arranged under the wiper and collects the ink wiped off with the wiper. The collecting tray includes a discharge port that discharges the collected ink. The ink discharged from the discharge port is accumulated in a waste ink container.

There is proposed an ink-jet recording apparatus that performs a recovery process of a recording head with a wipe unit.

SUMMARY

A wipe unit according to one aspect of the disclosure cleans a recording head having an ink discharge surface on which an ink discharge opening that discharges an ink onto a recording medium opens. The wipe unit includes a wiper and a collecting tray. The wiper wipes off an ink forcibly extruded from the ink discharge opening. The collecting tray is arranged under the wiper. The collecting tray collects the ink wiped off with the wiper. The collecting tray includes a discharge port and a plurality of ribs. The discharge port discharges the collected ink downward, and the plurality of ribs are arranged so as to surround a peripheral area of the discharge port and arranged with a predetermined interval from one another in a circumferential direction of the discharge port.

These as well as other aspects, advantages, and alternatives will become apparent to those of ordinary skill in the art by reading the following detailed description with reference where appropriate to the accompanying drawings. Further, it should be understood that the description provided in this summary section and elsewhere in this document is intended to illustrate the claimed subject matter by way of example and not by way of limitation.

DETAILED DESCRIPTION

Figure 1:
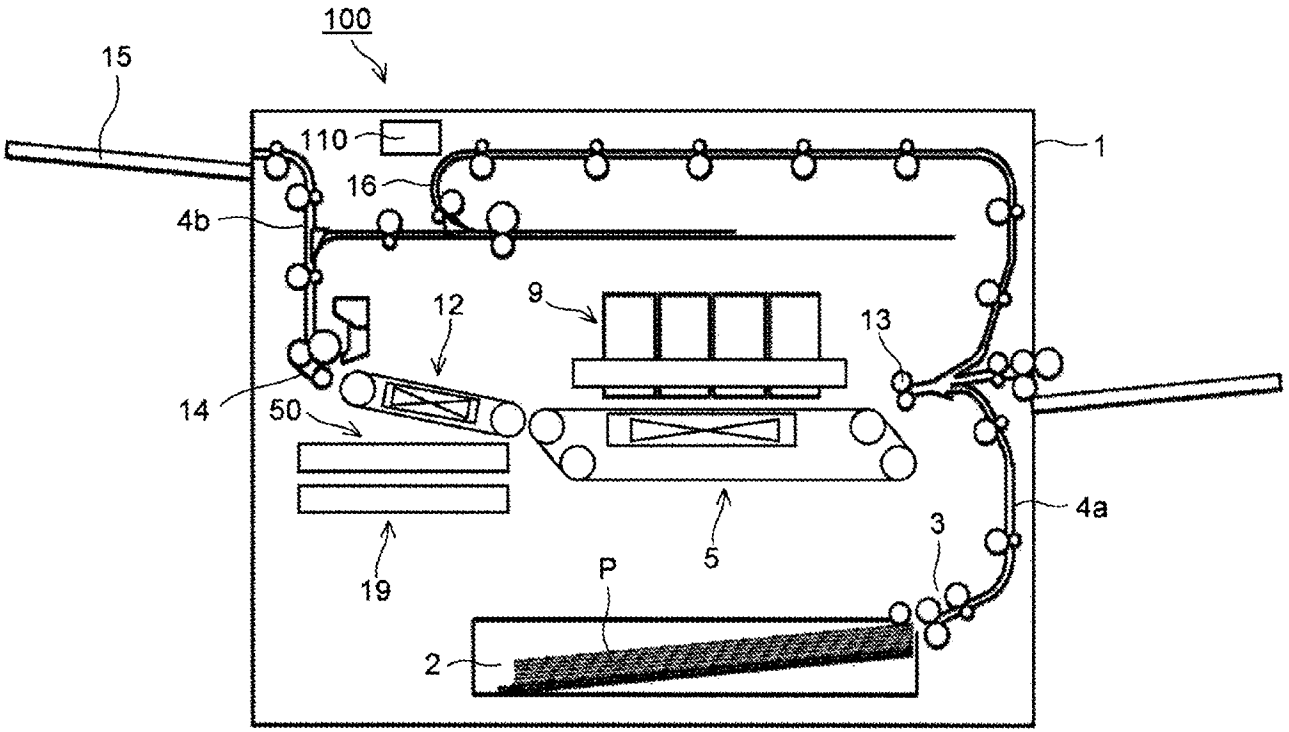
FIG. 1 illustrates a schematic configuration of a printer including a wipe unit according to one embodiment of the disclosure.

Example apparatuses are described herein. Other example embodiments or features may further be utilized, and other changes may be made, without departing from the spirit or scope of the subject matter presented herein. In the following detailed description, reference is made to the accompanying drawings, which form a part thereof.

The example embodiments described herein are not meant to be limiting. It will be readily understood that the aspects of the present disclosure, as generally described herein, and illustrated in the drawings, can be arranged, substituted, combined, separated, and designed in a wide variety of different configurations, all of which are explicitly contemplated herein.

The following describes an embodiment of the disclosure with reference to the drawings.

With reference to FIGS. 1 to 21, a description will be given of an inkjet-type printer 100 (ink-jet recording apparatus) that includes a wipe unit 19 according to one embodiment of the disclosure. As illustrated in FIG. 1, the printer 100 has a printer main body 1 inside which a sheet feed cassette 2 as a paper sheet housing portion is arranged in a lower side. The sheet feed cassette 2 internally houses paper sheets P as an exemplary recording medium. The sheet feed cassette 2 has a downstream in a paper sheet conveyance direction, that is, an upper side on a right side of the sheet feed cassette 2 in FIG. 1, in which a paper feeder 3 is arranged. This paper feeder 3 separates and sends out the paper sheets P one by one toward the upper right side of the sheet feed cassette 2 in FIG. 1.

The printer 100 internally includes a first paper sheet conveyance passage 4*a*. With regard to the sheet feed cassette 2, the first paper sheet conveyance passage 4*a* is located in the upper right side, which is a paper feeding direction of the sheet feed cassette 2. The first paper sheet conveyance passage 4*a* conveys the paper sheet P fed from the sheet feed cassette 2 perpendicularly upward along a side surface of the printer main body 1.

In a downstream end of the first paper sheet conveyance passage 4*a* in the paper sheet conveyance direction, a registration roller pair 13 is located. Additionally, a first conveyance unit 5 and a recording unit 9 are arranged immediately close to a downstream of the registration roller pair 13 in the paper sheet conveyance direction. The paper sheet P fed from the sheet feed cassette 2 reaches the registration roller pair 13 passing through the first paper sheet conveyance passage 4*a*. The registration roller pair 13 corrects oblique feeding of the paper sheet P and feeds the paper sheet P toward the first conveyance unit 5 by measuring timing with the ink discharging operation executed by the recording unit 9.

In a downstream (left side in FIG. 1) of the first conveyance unit 5 in the paper sheet conveyance direction, a second conveyance unit 12 is arranged. The paper sheet P where an ink image has been recorded by the recording unit 9 is transmitted to the second conveyance unit 12, and the ink discharged onto a surface of the paper sheet P is dried while the paper sheet P passes through the second conveyance unit 12.

In a downstream of the second conveyance unit 12 in the paper sheet conveyance direction and adjacent to a left side surface of the printer main body 1, a decurler unit 14 is located. The paper sheet P where the ink has been dried by the second conveyance unit 12 is fed to the decurler unit 14. Then, a curling caused in the paper sheet P is corrected.

In a downstream (upper side in FIG. 1) of the decurler unit 14 in the paper sheet conveyance direction, a second paper sheet conveyance passage 4*b* is located. When duplex recording is not performed, the paper sheet P having passed through the decurler unit 14 is discharged onto a paper-sheet discharge tray 15, which is located outside the left side surface of the printer 100, from the second paper sheet conveyance passage 4*b*.

In an upper portion of the printer main body 1 and over the recording unit 9 and the second conveyance unit 12, an inverting conveyance path 16 for performing duplex recording is located. When duplex recording is performed, the paper sheet P having passed through the second conveyance unit 12 and the decurler unit 14 after a termination of recording on a first surface is fed to the inverting conveyance path 16 through the second paper sheet conveyance passage 4*b*. Then, the conveyance direction of the paper sheet P fed to the inverting conveyance path 16 is switched for recording on a second surface, and the paper sheet P is fed rightward while passing through the upper portion of the printer main body 1. The paper sheet P is fed to the first conveyance unit 5 again in a state where the second surface faces upward through the first paper sheet conveyance passage 4*a* and the registration roller pair 13.

Under the second conveyance unit 12, the wipe unit 19 and a cap unit 50 are arranged. The wipe unit 19 horizontally moves under the recording unit 9 when a purge, which will be described later, is executed to wipe off the ink extruded from ink discharge openings of recording heads and collects the wiped off ink. The cap unit 50 horizontally moves under the recording unit 9 when ink discharge surfaces of the recording heads are capped, and further moves upward to be mounted on lower surfaces of the recording heads.

Figure 2:
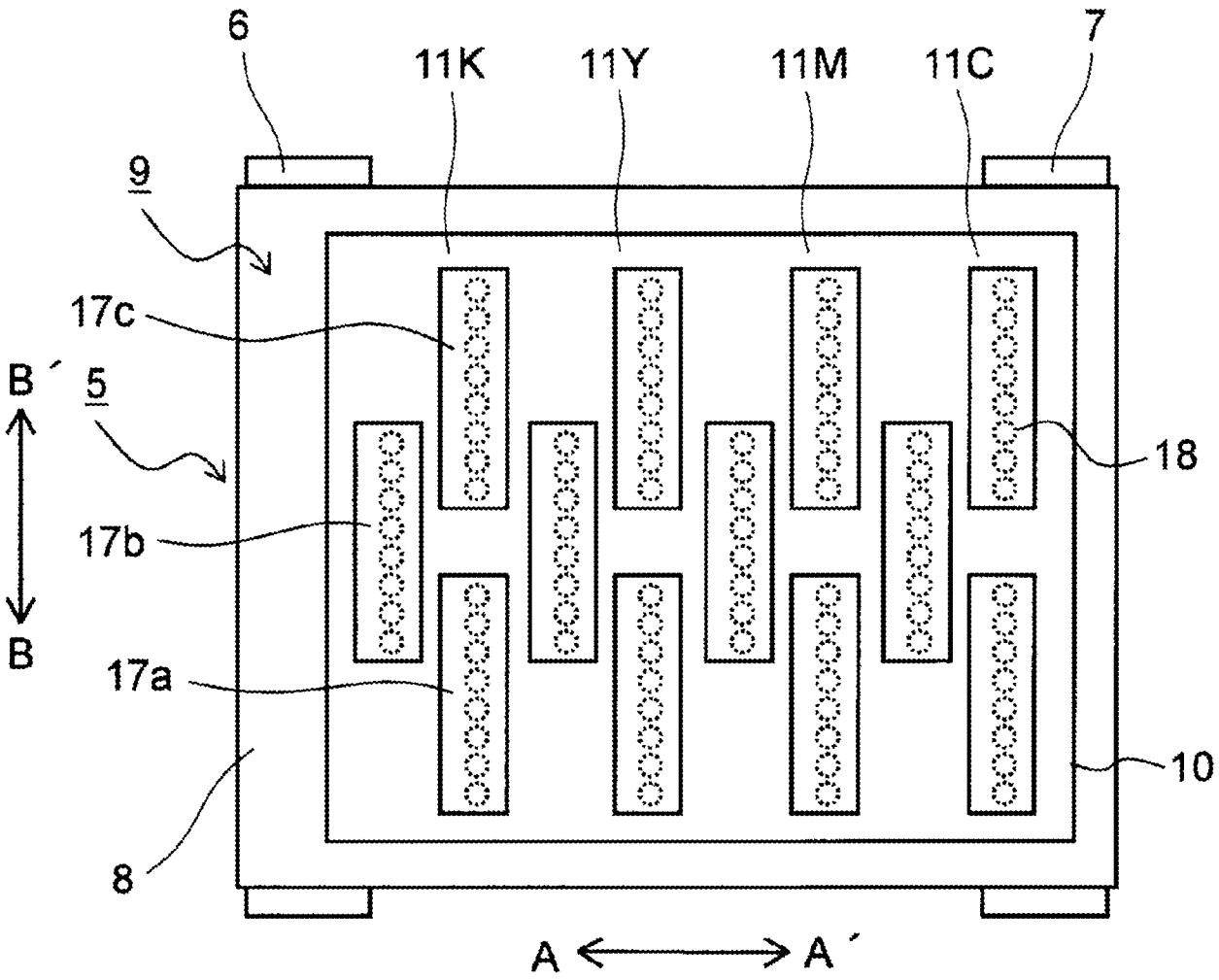
FIG. 2 illustrates a first conveyance unit and a recording unit of the printer according to the one embodiment from above.
Figure 3:
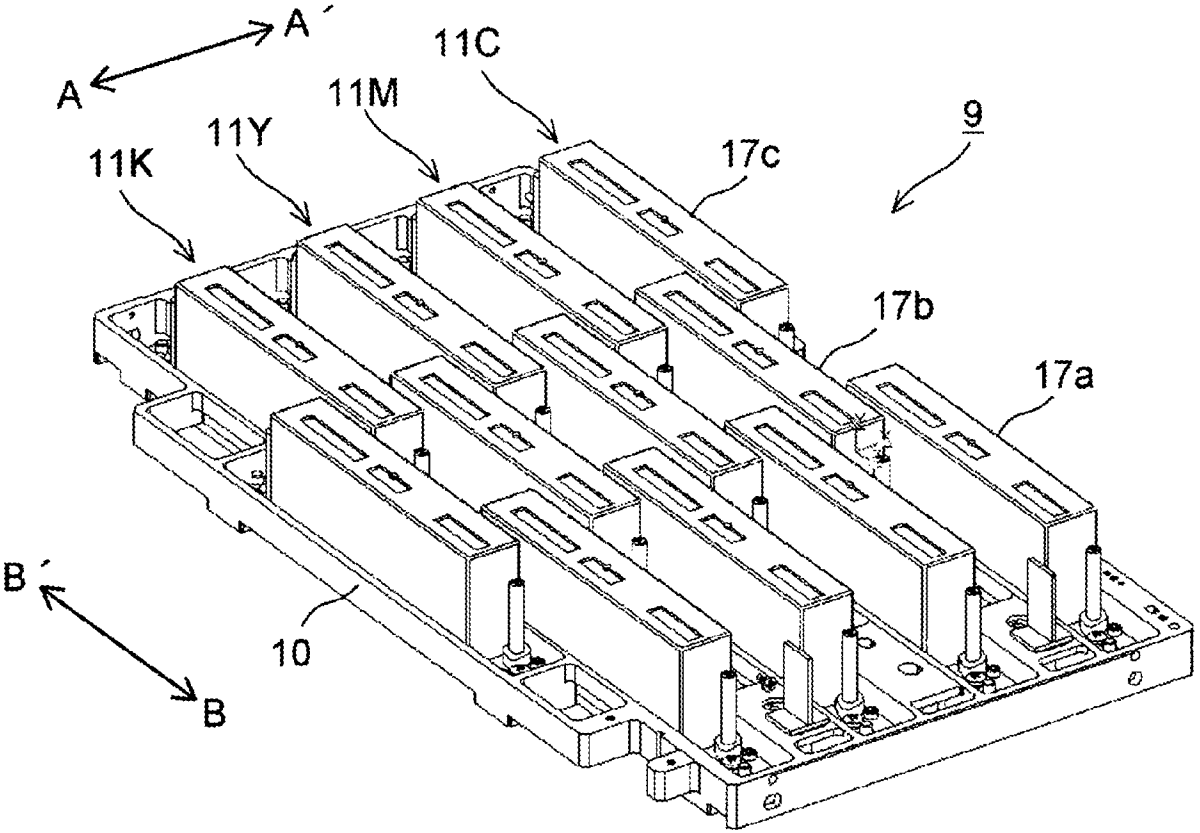
FIG. 3 illustrates a structure of the recording unit of the printer according to the one embodiment.

The recording unit 9 includes a head housing 10 and line heads 11C, 11M, 11Y and 11K held in the head housing 10 as illustrated in FIGS. 2 and 3. These line heads 11C to 11K are supported at a height where a predetermined interval (for example, 1 mm) is formed with respect to a conveying surface of a first conveyance belt 8 stretched over a plurality of rollers including a drive roller 6 and a driven roller 7. In these line heads 11C to 11K, a plurality (here, three) of recording heads 17*a* to 17*c* are arrayed in staggered along a paper sheet width direction (direction of arrow BB') perpendicular to the paper sheet conveyance direction (direction of arrow A).

Figure 4:
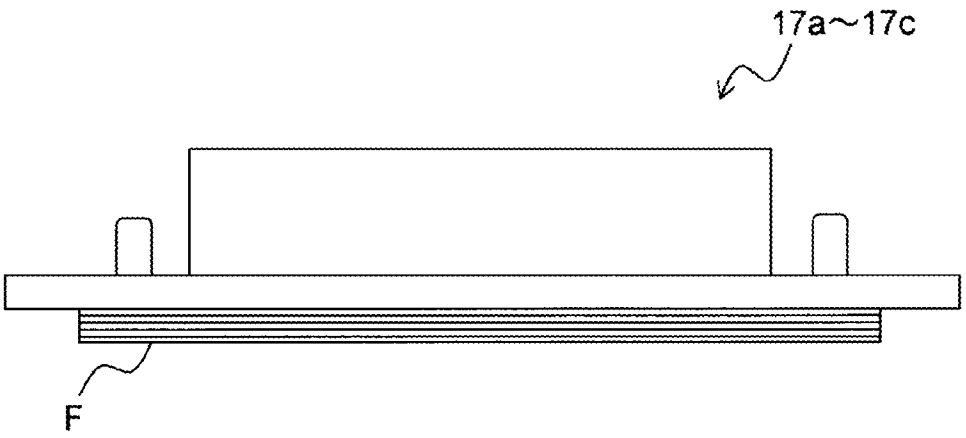
FIG. 4 illustrates a structure of a recording head that constitutes a line head of the recording unit of the printer according to the one embodiment.
Figure 5:
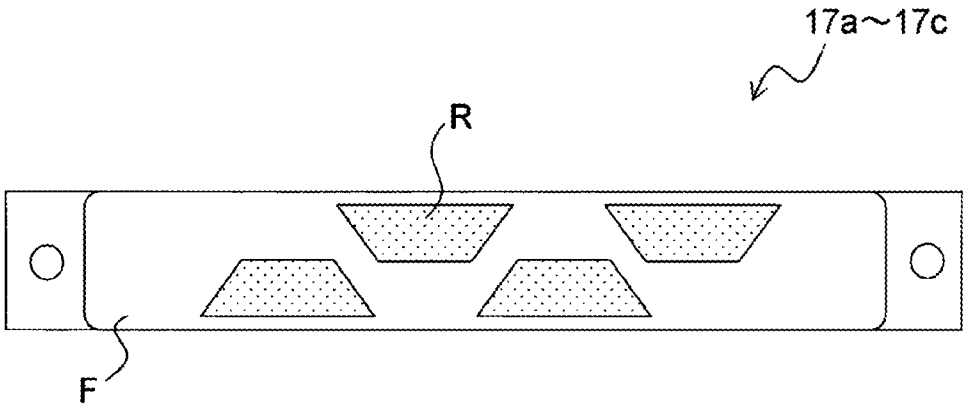
FIG. 5 illustrates the recording head of the printer according to the one embodiment from an ink discharge surface side.

As illustrated in FIGS. 4 and 5, ink discharge surfaces F for the recording heads 17*a* to 17*c* include ink discharge regions R where multiple ink discharge openings 18 (see FIG. 2) are arrayed. In FIGS. 4 and 5, since the recording heads 17*a* to 17*c* have the identical shape and configuration, the recording heads 17*a* to 17*c* are illustrated by one figure.

Four color (cyan, magenta, yellow, and black) inks stored in respective ink tanks (not illustrated) are supplied to the recording heads 17*a* to 17*c*, which constitute the respective line heads 11C to 11K, for the respective colors of the line heads 11C to 11K.

Corresponding to image data received from an external computer or similar unit, each of the recording heads 17*a* to 17*c* discharges an ink from the ink discharge openings 18 toward the paper sheet P, which is conveyed while being suctioned and held to the conveying surface of the first conveyance belt 8, by a control signal from a control unit 110 (see FIG. 1) that controls the whole printer 100. This forms a color image, where inks in four colors of cyan, magenta, yellow, and black are superposed, on the paper sheet P on the first conveyance belt 8.

In this printer 100, the ink is forcibly discharged from the ink discharge openings 18 of all the recording heads 17*a* to 17*c*, and the ink discharge surfaces F are wiped off with wipers 35*a* to 35*c*, which will be described later, in preparation for the next printing operation, when printing starts after stopping for a long period of time and between printing operations, in order to clean the ink discharge surfaces F of the recording heads 17*a* to 17*c*.

Next, a detailed description will be given of the cap unit 50 and the wipe unit 19, and a structure in a peripheral area.

Figure 6:
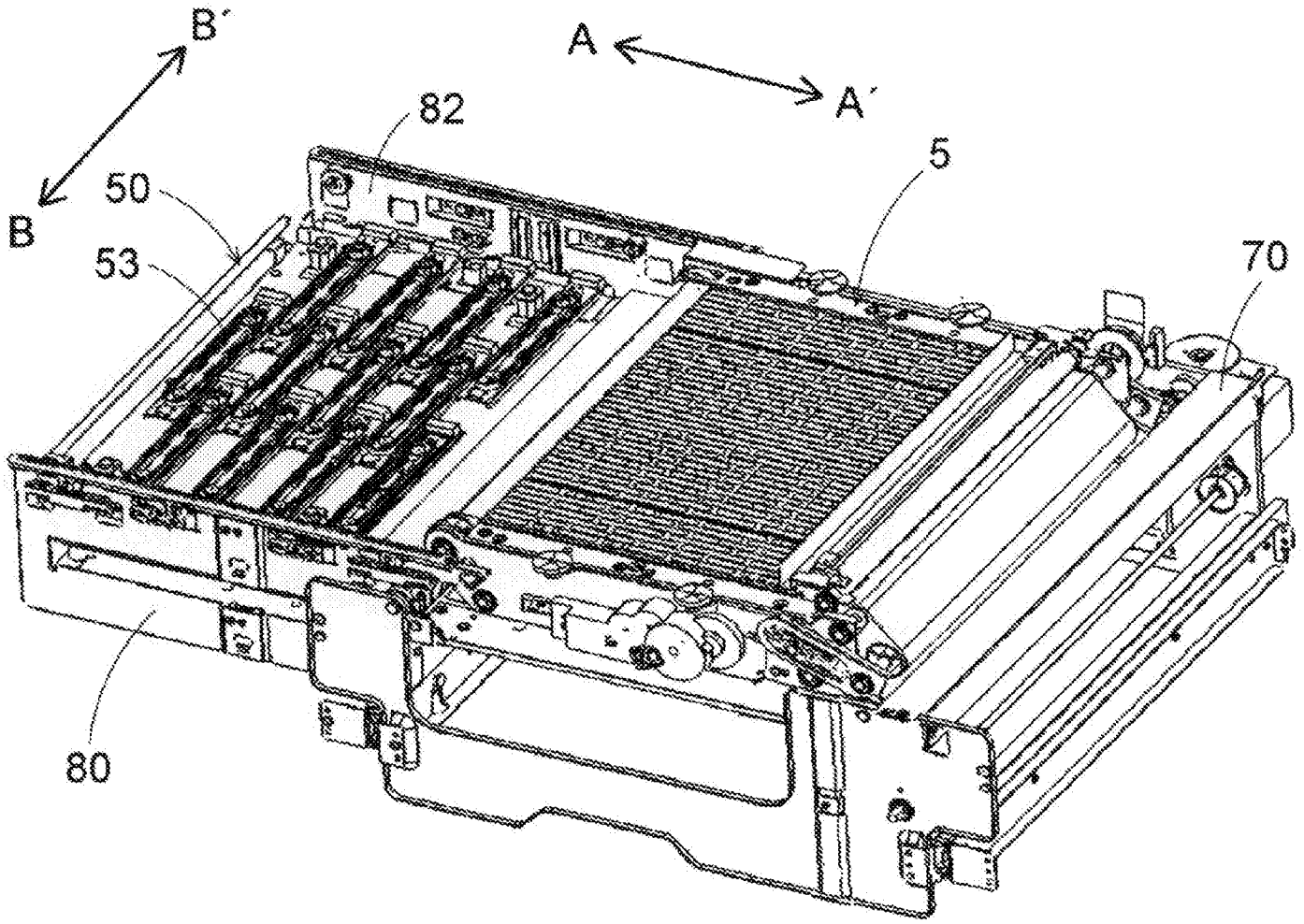
FIG. 6 illustrates a structure of, for example, a cap unit and a first conveyance unit of the printer according to the one embodiment and illustrates a state where the first conveyance unit is arranged at an elevated position.
Figure 7:
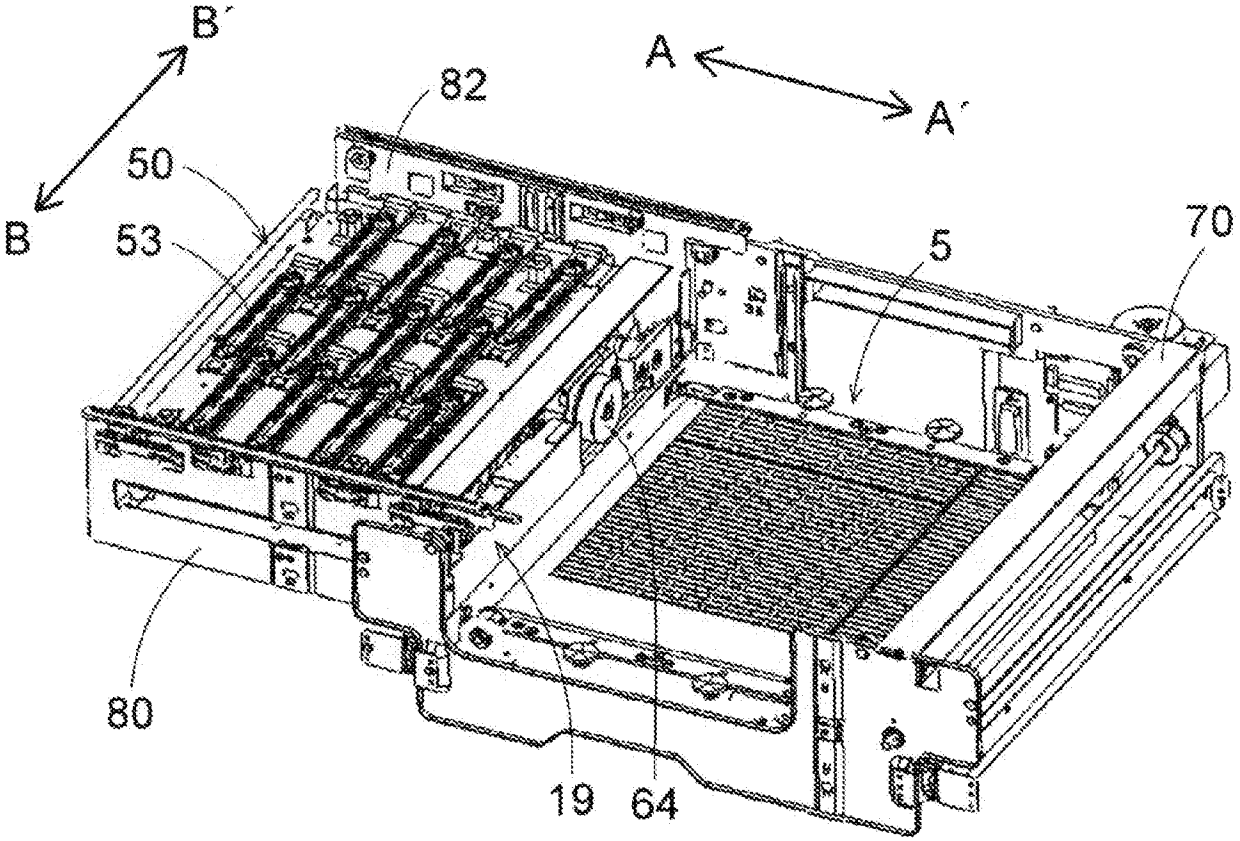
FIG. 7 illustrates a structure of, for example, the cap unit and the first conveyance unit of the printer according to the one embodiment and illustrates a state where the first conveyance unit is arranged at a descended position.

As illustrated in FIGS. 6 and 7, the first conveyance unit 5 is housed in a housing frame 70. The first conveyance unit 5 is configured to be liftable in an up and down direction by a conveyance elevating mechanism (not illustrated) made of, for example, an elevating driving source and a gear train. The first conveyance unit 5 is arranged at an elevated position (position in FIG. 6) when in the printing operation and is close to the ink discharge surfaces F of the recording heads 17*a* to 17*c*. The first conveyance unit 5 is arranged at a descended position (position in FIG. 7) when in a recovery operation and in a capping operation, which are described later, of the recording heads 17*a* to 17*c*.

Figure 8:
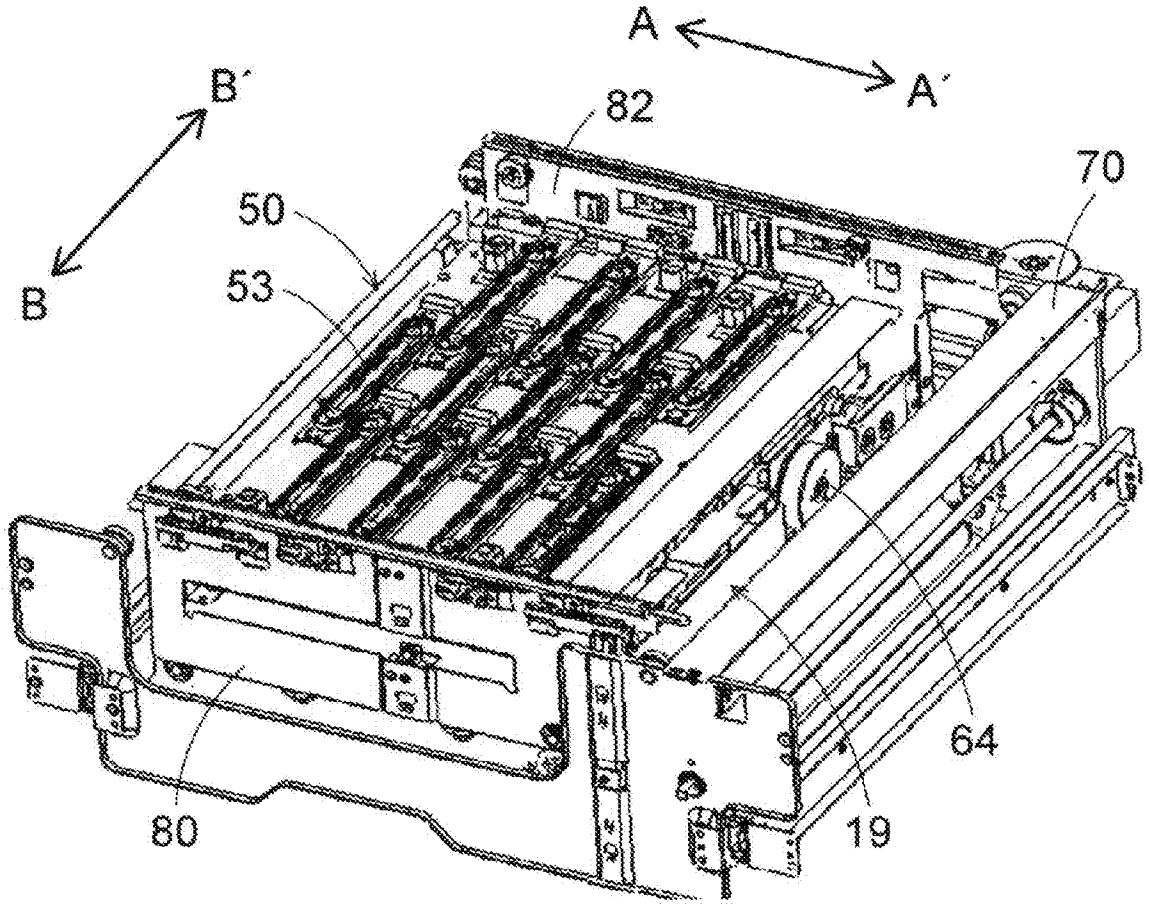
FIG. 8 illustrates a structure of, for example, the cap unit of the printer according to the one embodiment and illustrates a state where the cap unit and the wipe unit are arranged at a first position.
Figure 9:
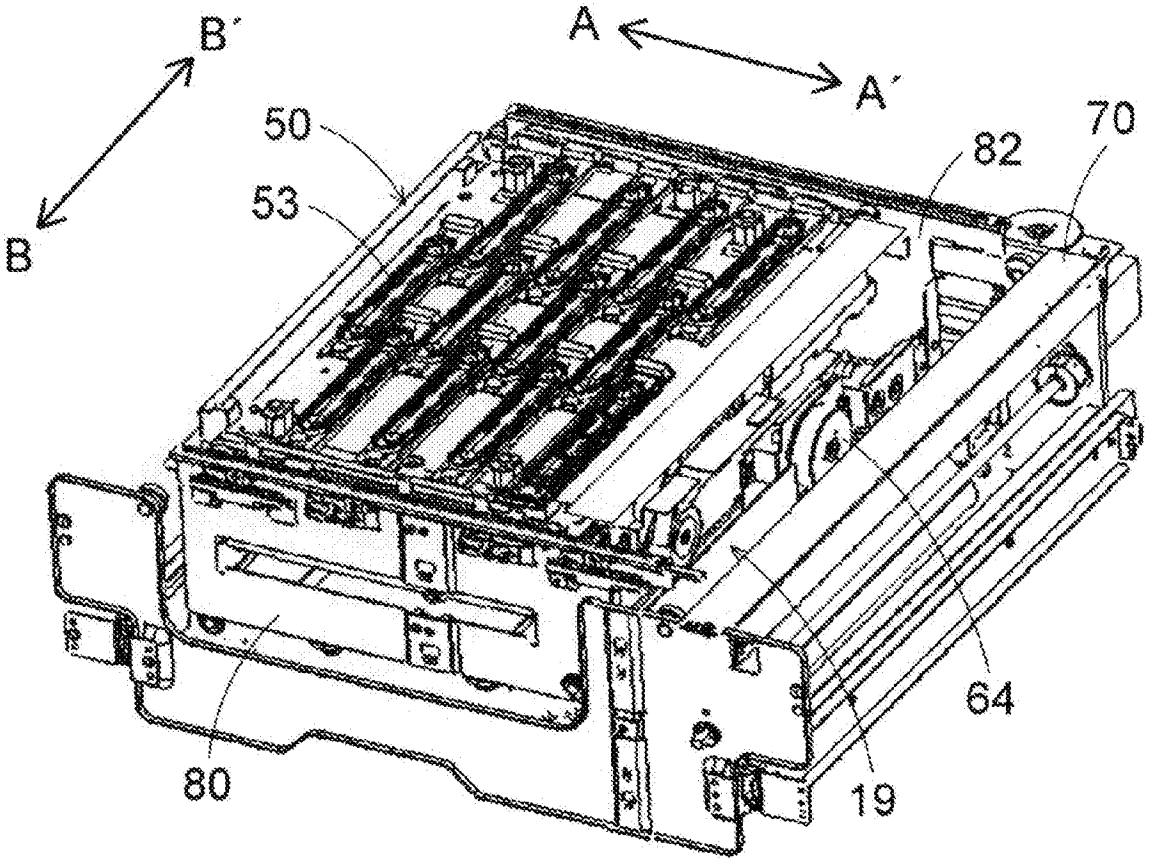
FIG. 9 illustrates a state where the cap unit and the wipe unit are moved up from the state in FIG. 8.

The cap unit 50 is configured to be movable back and forth between a first position (position in FIG. 8) immediately under the recording unit 9 and a second position (position in FIG. 7) where the cap unit 50 is retreated in a horizontal direction (direction of arrow A) from the first position as illustrated in FIGS. 7 and 8. When the cap unit 50 is arranged in the first position, the first conveyance unit 5 is arranged in the descended position. As illustrated in FIGS. 8 and 9, the cap unit 50 is configured to be liftable in the up and down direction at the first position.

The cap unit 50 is arranged at the second position (position in FIG. 6) when in the printing operation and in the recovery operation. The cap unit 50 is configured to move upward in the first position (positions in FIGS. 8 and 9) to cap the recording heads 17*a* to 17*c* when in the capping operation. The cap unit 50 is configured to be coupled/uncoupled to/from the wipe unit 19 at the second position as described later. The move of the cap unit 50 in the horizontal direction and in the up and down direction is performed by the wipe unit 19 moving in a state of being coupled to the cap unit 50.

Figure 10:
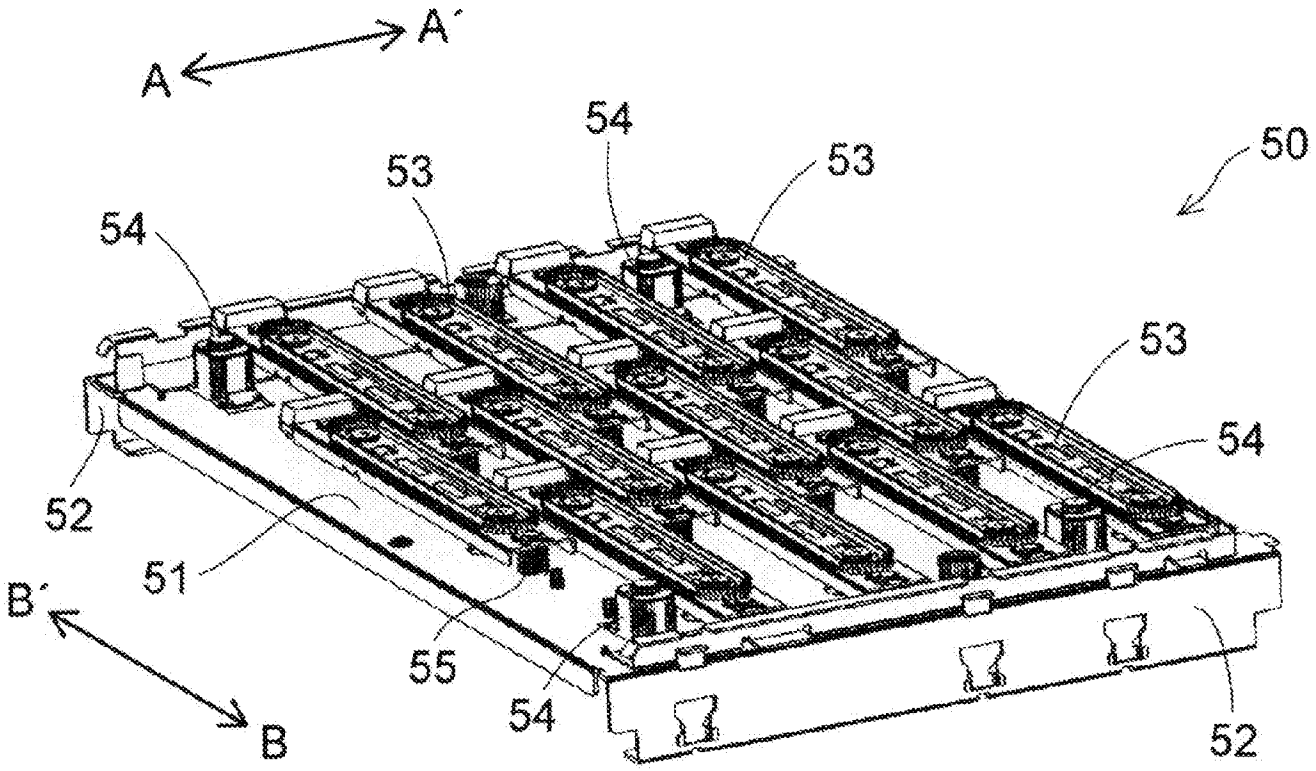
FIG. 10 illustrates a structure of the cap unit of the printer according to the one embodiment.

As illustrated in FIG. 10, the cap unit 50 includes a cap tray 51 made of a sheet metal, a pair of tray side plates 52 formed at both ends in the paper sheet width direction (direction of arrow BB') of the cap tray 51, twelve cap portions 53 in depressed shapes arranged on a top surface of the cap tray 51, and four height direction positioning protrusions 54.

The cap portions 53 are arranged at positions corresponding to the recording heads 17*a* to 17*c*. In view of this, the cap unit 50 moving upward at the first position as illustrated in FIG. 9 causes the respective cap portions 53 to cap the ink discharge surfaces F of the respective recording heads 17*a* to 17*c*. The height direction positioning protrusions 54 perform positioning of the cap tray 51 in a height direction by abutting on the head housing 10 of the recording unit 9 when the cap unit 50 is moved up to a side of the recording unit 9 in order to cap the recording heads 17*a* to 17*c*. Between lower portions at both ends of the cap portions 53 in a longitudinal direction (direction of arrow BB') and the cap tray 51, cap springs 55 made of compression springs are arranged. The cap springs 55 hold contacting states between the cap portions 53 and the ink discharge surfaces F in a constant manner.

Figure 11:
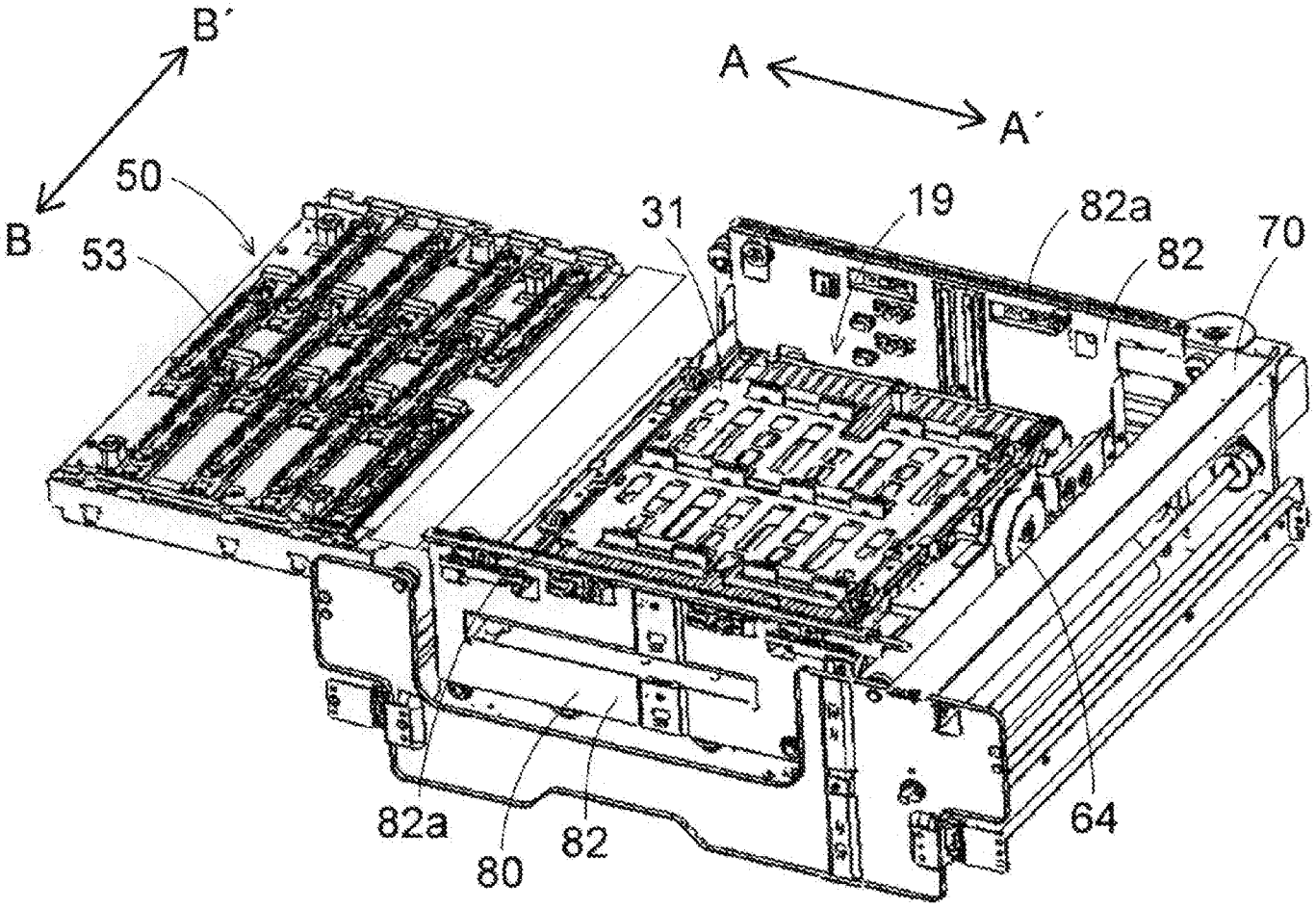
FIG. 11 illustrates a structure of, for example, the cap unit and the wipe unit of the printer according to the one embodiment and illustrates a state where the cap unit is arranged at a second position and the wipe unit is arranged at the first position.
Figure 12:
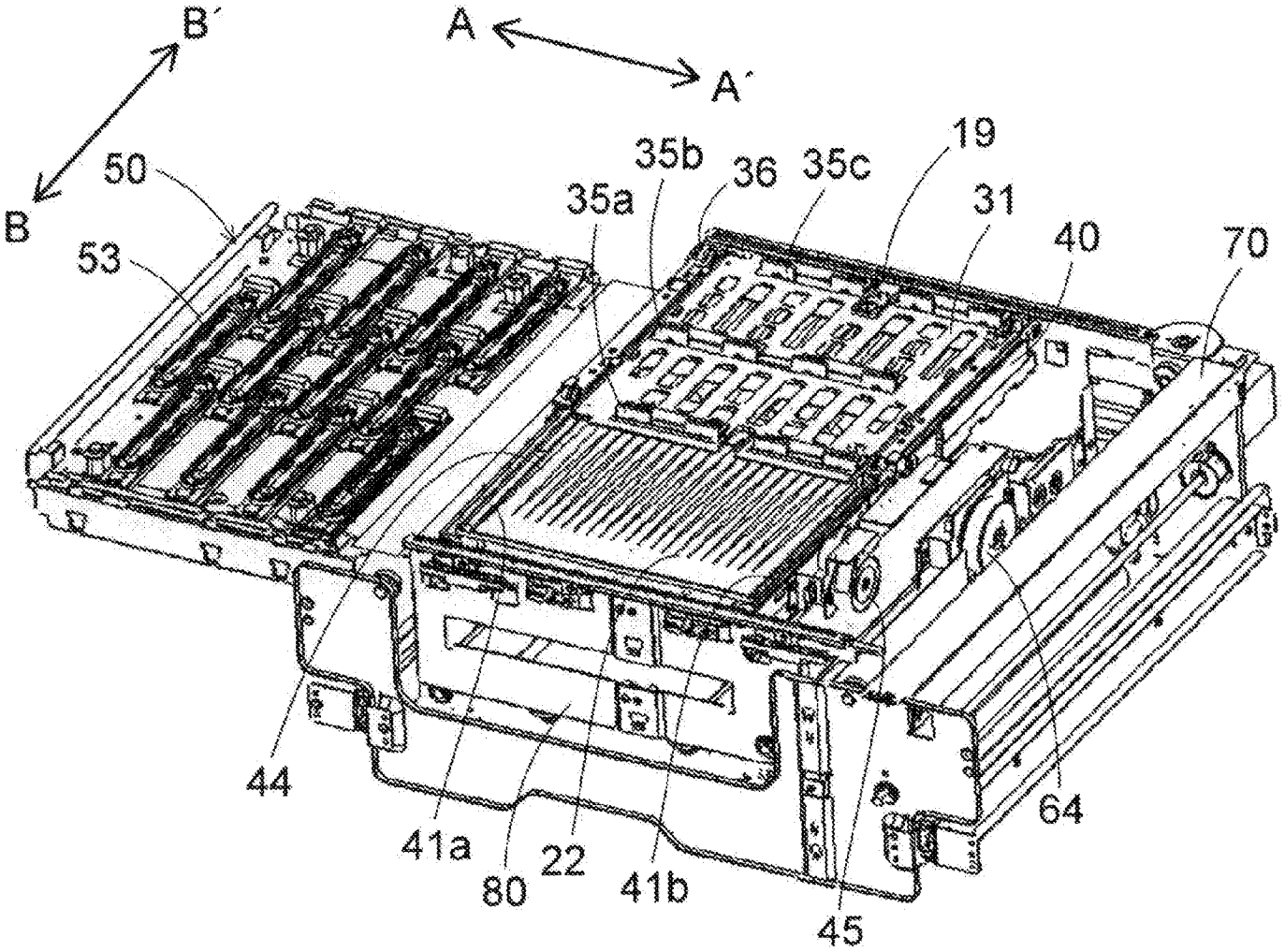
FIG. 12 illustrates a state where the wipe unit is moved up from the state in FIG. 11.

As illustrated in FIGS. 7 and 11, the wipe unit 19 is configured to be movable back and forth between the first position (position in FIG. 11) immediately under the recording unit 9 and the second position (position in FIG. 7) where the wipe unit 19 is retreated in the horizontal direction (direction of arrow A) from the first position. When the wipe unit 19 is arranged in the first position, the first conveyance unit 5 is arranged at the descended position. As illustrated in FIGS. 11 and 12, the wipe unit 19 is configured to be liftable in the up and down direction at the first position.

The wipe unit 19 is arranged at the second position when in the printing operation. The wipe unit 19 is configured to move upward at the first position (position in FIG. 11) when in the recovery operation and the capping operation.

Figure 13:
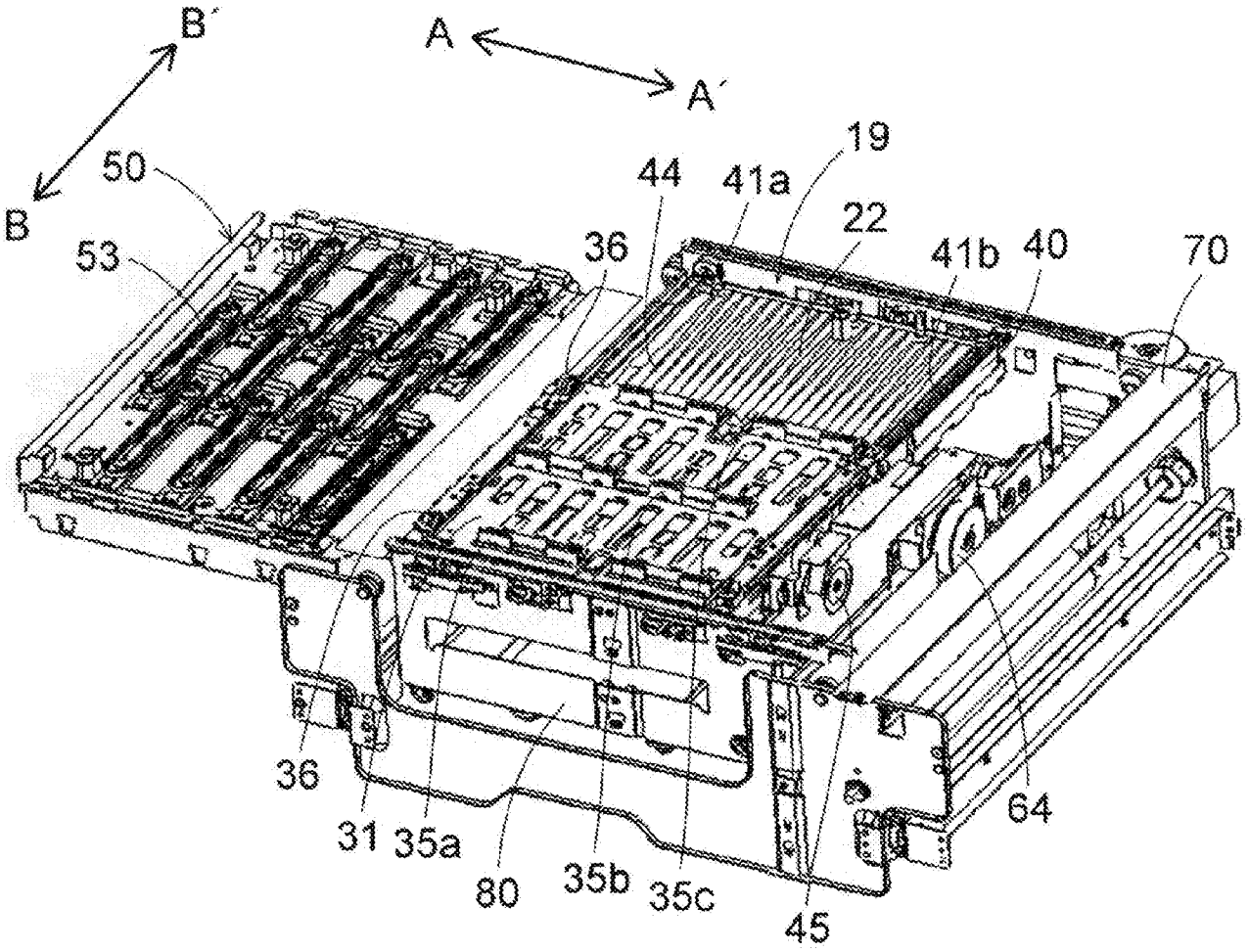
FIG. 13 illustrates a state where a wiper carriage is moved in a direction of an arrow B from the state in FIG. 12.

As illustrated in FIGS. 12 and 13, the wipe unit 19 is configured of a rectangular shaped wiper carriage 31 to which a plurality of the wipers 35*a* to 35*c* are secured and a support frame 40 that supports the wiper carriage 31.

On end edges, which oppose a direction of an arrow AA', on a top surface of the support frame 40, rail portions 41*a* and 41*b* are formed. Rollers 36 located at four corners of the wiper carriage 31 abut on the rail portions 41*a* and 41*b*, and thus, the wiper carriage 31 is slidably supported in the direction of the arrow BB' with respect to the support frame 40.

Outside the support frame 40, a wiper carriage moving motor 45 for moving the wiper carriage 31 in the horizontal direction (direction in arrow BB') and a gear train (not illustrated) that engages with rack teeth (not illustrated) of the wiper carriage moving motor 45 and the wiper carriage 31 are mounted. The wiper carriage moving motor 45 rotating in positive and negative directions causes the gear train to rotate in the positive and negative directions, and thus, the wiper carriage 31 reciprocates in the horizontal direction (direction in arrow BB').

The wipers 35*a* to 35*c* are elastic members (rubber member made of, for example, EPDM) for wiping off the ink extruded from the ink discharge openings 18 of the respective recording heads 17*a* to 17*c*. The wipers 35*a* to 35*c* are brought into pressure contact with wipe-off start positions outside the ink discharge regions R (see FIG. 5) where the ink discharge openings 18 open from an approximately perpendicular direction. The move of the wiper carriage 31 wipes off the ink discharge surfaces F including the ink discharge regions R in a predetermined direction (direction in arrow B in FIG. 12).

The four wipers 35*a* are arranged at approximately regular intervals, and similarly, the four wipers 35*b* and the four wipers 35*c* are also arranged at respective approximately regular intervals. The wipers 35*a* and 35*c* are arranged at positions corresponding to the recording heads 17*a* and 17*c* (see FIG. 3) that constitute the respective line heads 11C to 11K. The wipers 35*b* are arranged at positions corresponding to the recording heads 17*b* (see FIG. 3) that constitute the respective line heads 11C to 11K. The wipers 35*b* are secured by being shifted by a predetermined distance in a direction (direction of arrow AA') perpendicular to a moving direction of the wiper carriage 31 with respect to the wipers 35*a* and 35*c*.

On the top surface of the support frame 40, a collecting tray 44 for collecting a waste ink wiped off from the ink discharge surfaces F with the wipers 35*a* to 35*c* are arranged. The waste ink collected in the collecting tray 44 is accumulated in a waste ink tank 93, which will be described later. A structure of a peripheral area of the collecting tray 44 will be described later.

As illustrated in FIG. 7, the wipe unit 19 is housed in a carriage 80 having a cross-sectional surface in a U shape, and is arranged under the cap unit 50 at the second position. The wipe unit 19 integrally moves with the carriage 80 when moving in the horizontal direction (direction of arrow AA') as illustrated in FIGS. 7 and 11, and moves in the up and down direction with respect to the carriage 80 when moving in the up and down direction as illustrated in FIGS. 11 and 12.

Figure 14:
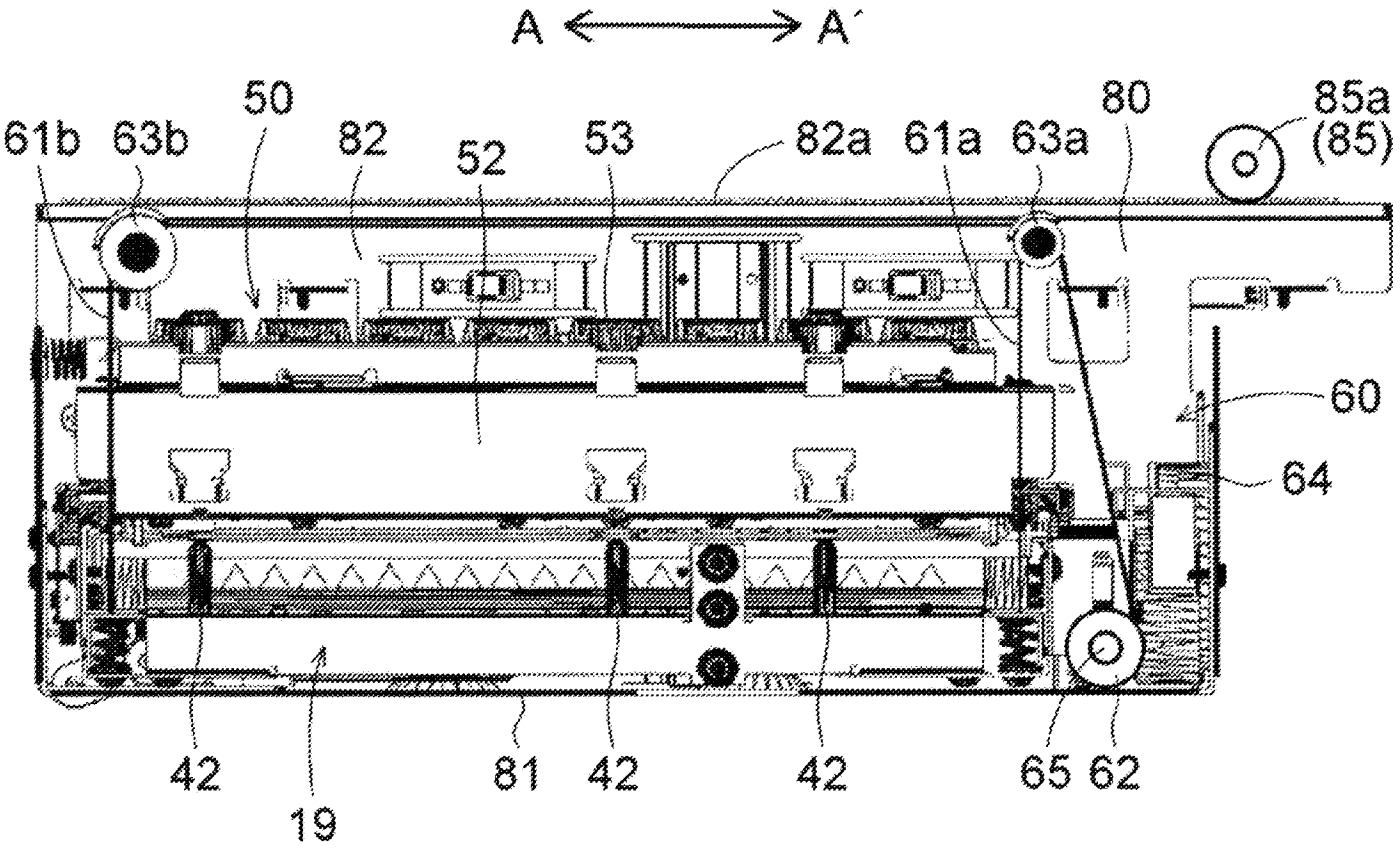
FIG. 14 illustrates a structure in a peripheral area of a unit elevating mechanism of the printer according to the one embodiment.

The carriage 80 is configured of a carriage bottom plate 81 (see FIG. 14) made of a sheet metal and a pair of carriage side plates 82 located standing at both ends of the carriage bottom plate 81 in the paper sheet width direction (direction in arrow BB'). The wipe unit 19 is placed on the carriage bottom plate 81. The carriage side plates 82 are configured to be slidable with respect to carriage support rails (not illustrated) of the printer main body 1. The carriage side plate 82 has a top surface on which a rack 82*a* having rack teeth is formed as illustrated in FIG. 14. The rack 82*a* is engaged with a gear 85*a*. The gear train including the gear 85*a* is coupled to a carriage driving source (not illustrated) made of a motor. The carriage driving source rotating in the positive and negative directions causes the gear train to rotate in the positive and negative directions, and thus, the carriage 80 reciprocates between the first position and the second position. The gear train including the gear 85*a* and the carriage driving source constitute a unit horizontal move mechanism 85 that moves the cap unit 50 and the wipe unit 19 in the horizontal direction.

The carriage 80 internally includes a unit elevating mechanism 60 that moves the wipe unit 19 in the up and down direction as illustrated in FIG. 14. The unit elevating mechanism 60 includes wires 61*a* and 61*b*, a winding up pulley 62 that rolls up the wires 61*a* and 61*b*, pulleys 63*a* and 63*b* that changes directions of the wires 61*a* and 61*b*, and a winding up drive motor (winding up driving source) 64.

The wire 61*a* is mounted on a lower portion of the wipe unit 19 in the direction of the arrow A' from the winding up pulley 62 via the pulley 63*a*. The wire 61*b* is mounted on a lower portion of the wipe unit 19 in the direction of the arrow A from the winding up pulley 62 via the pulleys 63*a* and 63*b*. Each of the wires 61*a* and 61*b*, the winding up pulley 62, the pulleys 63*a* and 63*b* are located one each on both sides (front side and far-side with respect to paper surface of FIG. 14) in the direction of the arrow BB'. A pair of the winding up pulleys 62 are secured at both ends of one rotation shaft 65. A rotation shaft gear (not illustrated) that engages with a gear train (not illustrated) coupled to the winding up drive motor 64 is secured to the rotation shaft 65. The winding up drive motor 64 rotating in the positive and negative directions causes the winding up pulley 62 to rotate in the positive and negative directions.

Figure 15:
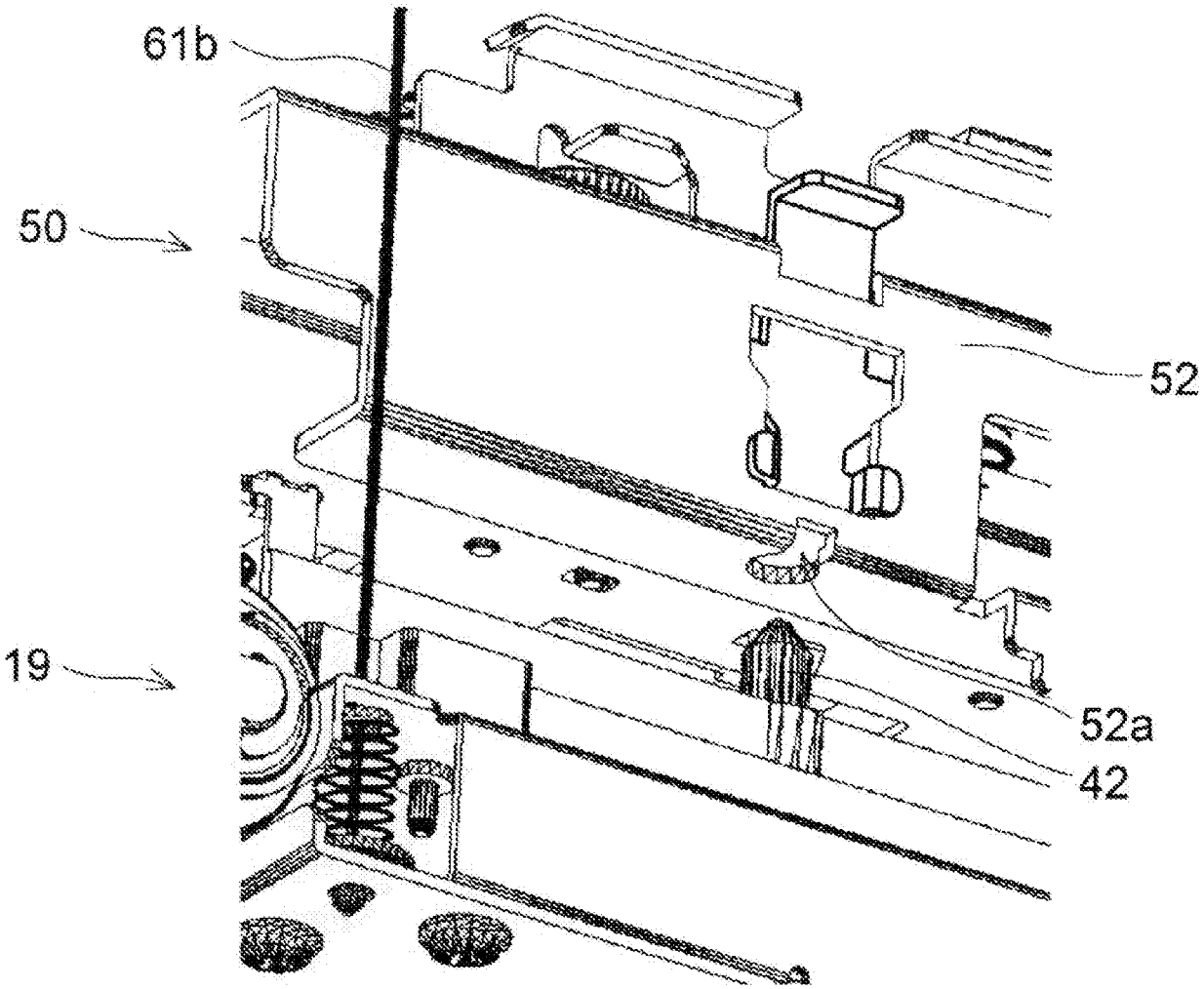
FIG. 15 illustrates a structure in a peripheral area of a coupling pin and a pushing-up piece of the printer according to the one embodiment and illustrates a state where the wipe unit is not coupled to the cap unit.

The wipe unit 19 includes a plurality of coupling pins 42 that extend upward as illustrated in FIGS. 14 and 15. The tray side plate 52 of the cap unit 50 has a lower surface on which coupling holes 52*a* (see FIG. 15) are formed at positions corresponding to the coupling pins 42. The coupling pins 42 and the coupling holes 52*a* constitute a coupling mechanism that couples or uncouples the cap unit 50 to or from the wipe unit 19.

Figure 16:
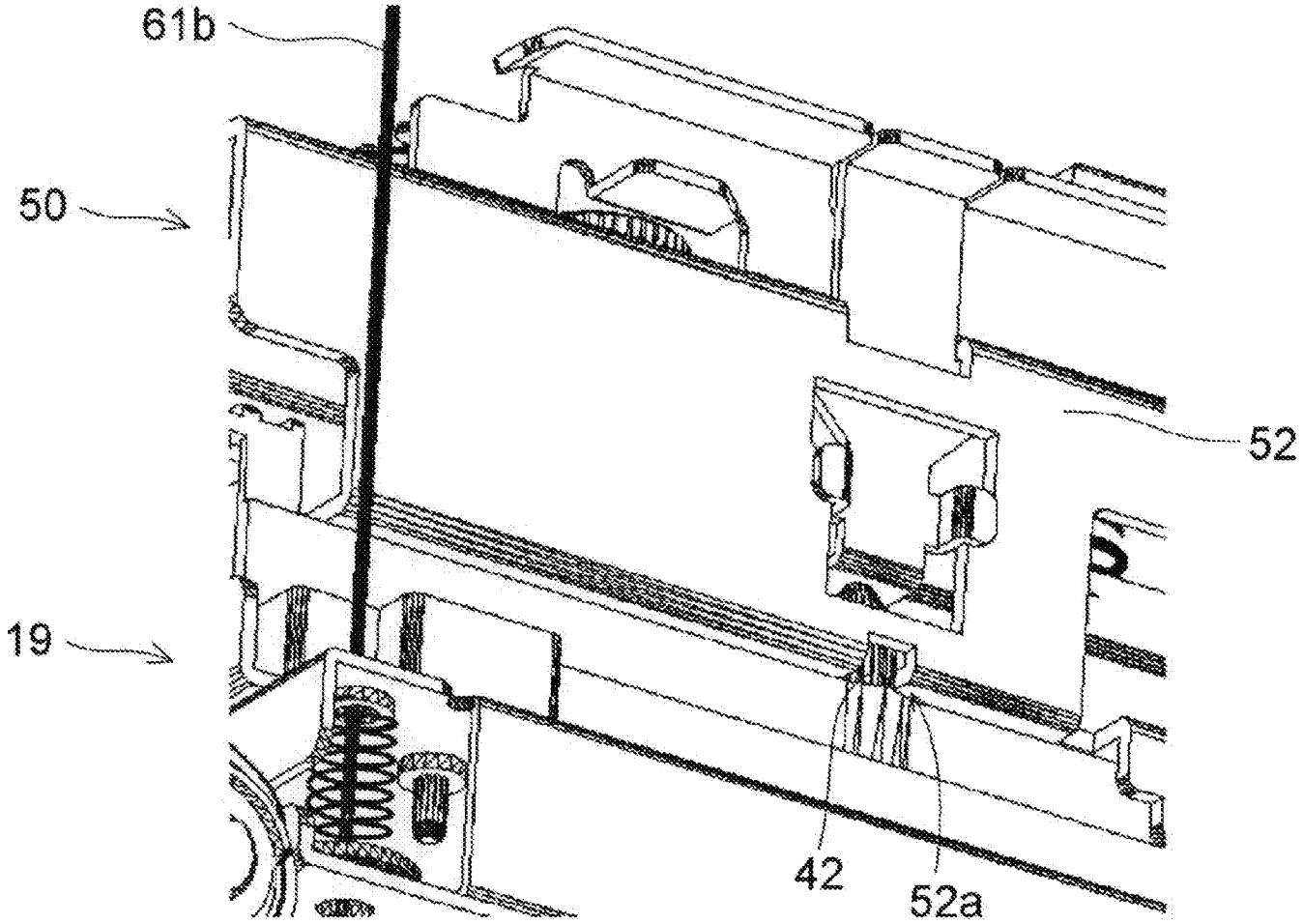
FIG. 16 illustrates a structure in the peripheral area of the coupling pin and the pushing-up piece of the printer according to the one embodiment and illustrates a state where the wipe unit is coupled to the cap unit.

In a state where the wipe unit 19 is moved down at the second position (state in FIG. 14, state of being arranged at a first height position), the coupling pins 42 are not inserted in the coupling holes 52*a* as illustrated in FIG. 15, and therefore, the wipe unit 19 is not coupled to the cap unit 50 (uncoupled). Meanwhile, when the wipe unit 19 is moved up at the second position (being arranged at a second height position higher than the first height position), the coupling pins 42 are inserted into the coupling holes 52*a* as illustrated in FIG. 16, and therefore, the wipe unit 19 is coupled to the cap unit 50. This integrates the cap unit 50 with the wipe unit 19 to ensure the move in the horizontal direction and the up and down direction.

At the second position, a cap supporting portion (not illustrated) that supports the cap unit 50 in a state where the wipe unit 19 is not coupled to the cap unit 50 (uncoupled state) is located. At the second position, a lid member (not illustrated) is located. The lid member protects the cap portions 53 by closely contacting the cap portions 53 of the cap unit 50 in a state where the wipe unit 19 is not coupled to the cap unit 50 (state except in capping operation (in printing operation and in recovery operation)). The lid member (not illustrated) closely contacts the cap portions 53 from above to prevent foreign objects such as dust and paper dust from accumulating on top surfaces (surfaces closely contact ink discharge surfaces F) of the cap portions 53, and reduces a lack of water content caused by the water content inside the cap portions 53 being vaporized.

Next, a detailed description will be given of a structure in a peripheral area of the collecting tray 44.

Figure 17:
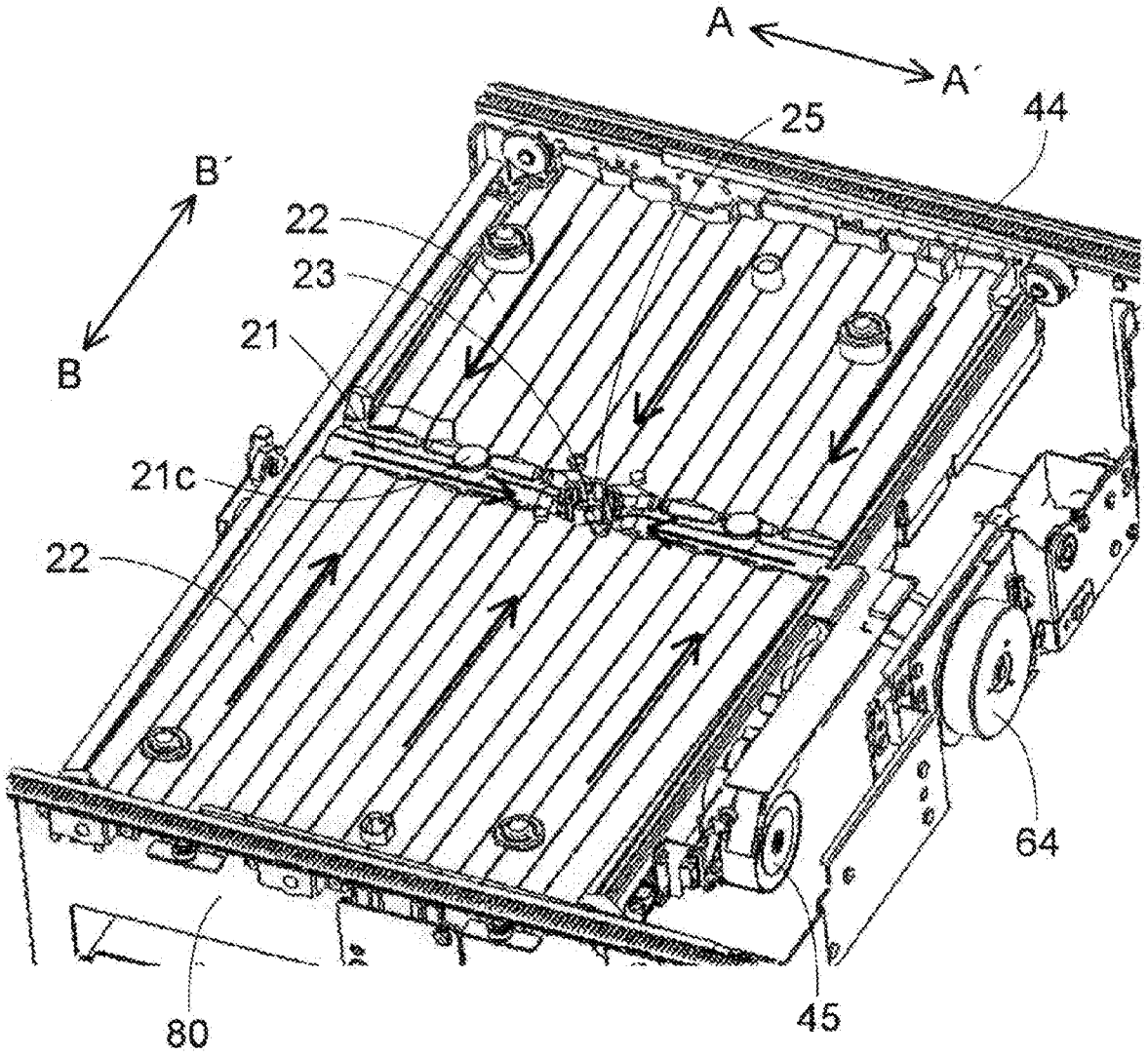
FIG. 17 illustrates a structure in a peripheral area of a collecting tray of the wipe unit according to the one embodiment.

As illustrated in FIG. 12, the collecting tray 44 is arranged under the wipers 35*a* to 35*c* to collect the ink wiped off with the wipers 35*a* to 35*c*. As illustrated in FIG. 17, the collecting tray 44 has a top surface on which a groove 21 and a pair of tray surfaces 22 are located. The groove 21 is arranged in the center in the direction of the arrow BB' and extends in the direction of the arrow AA'. The pair of tray surfaces 22 are arranged at both sides in the direction of the arrow BB' with the groove 21 interposed in between to receive the ink. The tray surfaces 22 incline downward toward the groove 21.

Figure 18:
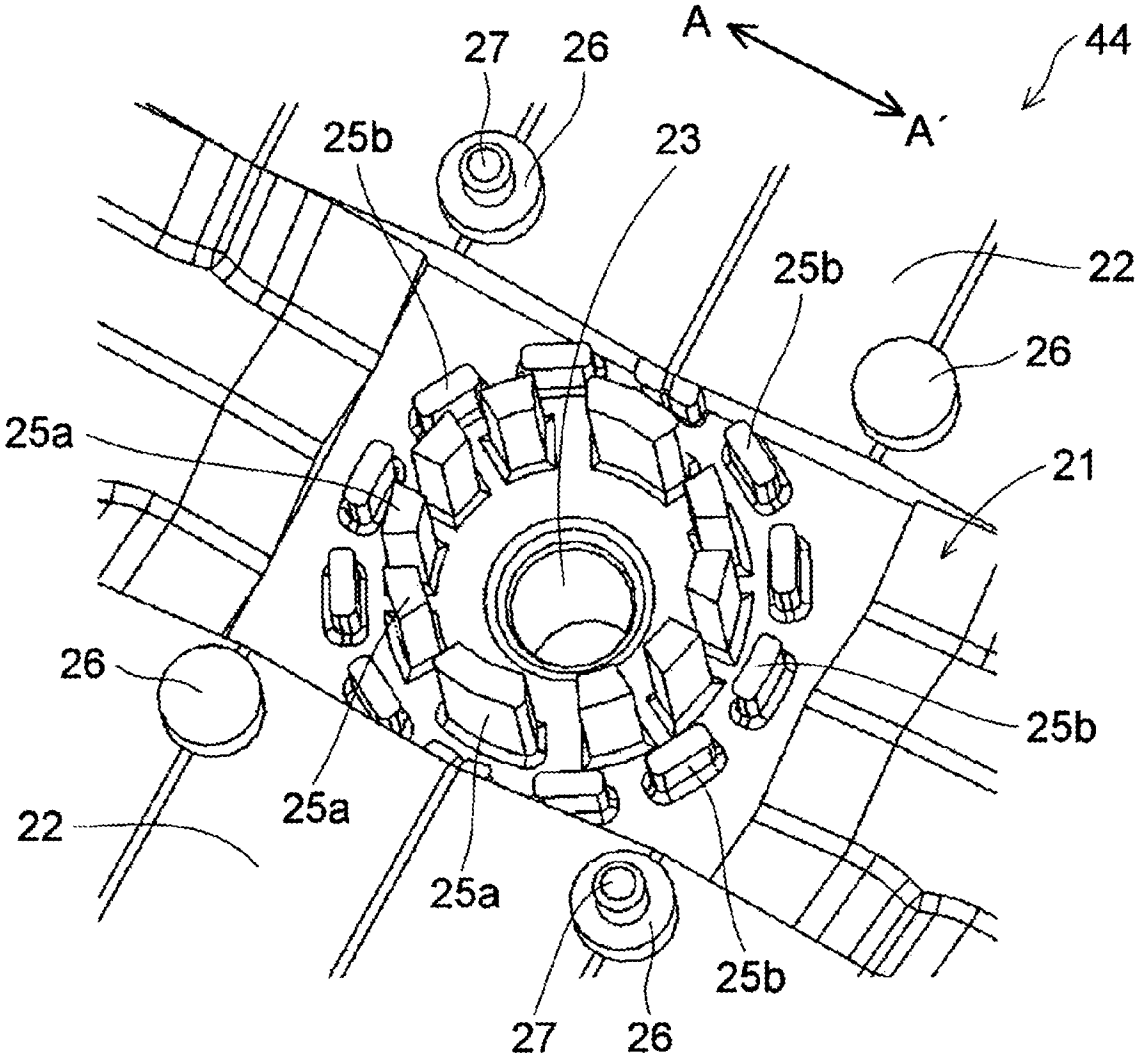
FIG. 18 illustrates a structure in a peripheral area of a discharge port of the collecting tray of the wipe unit according to the one embodiment.
Figure 19:
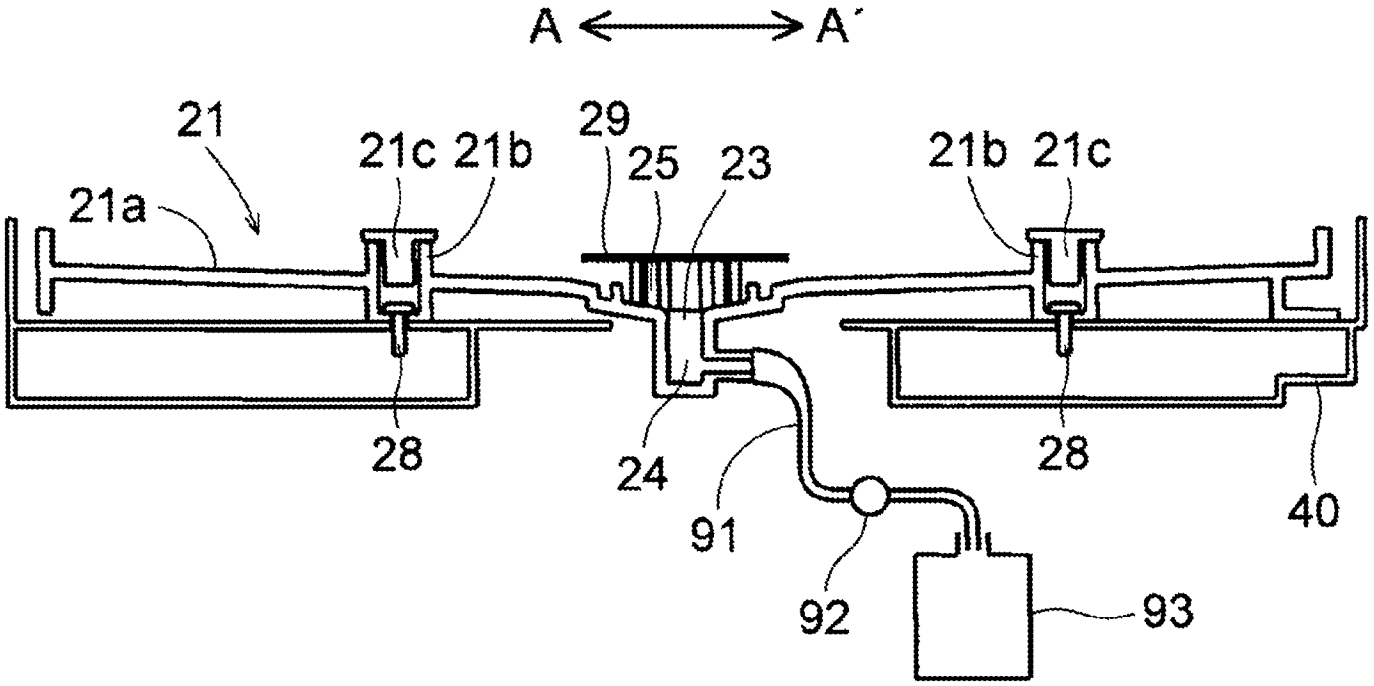
FIG. 19 illustrates a structure in a peripheral area of a groove of the collecting tray of the wipe unit according to the one embodiment.
Figure 20:
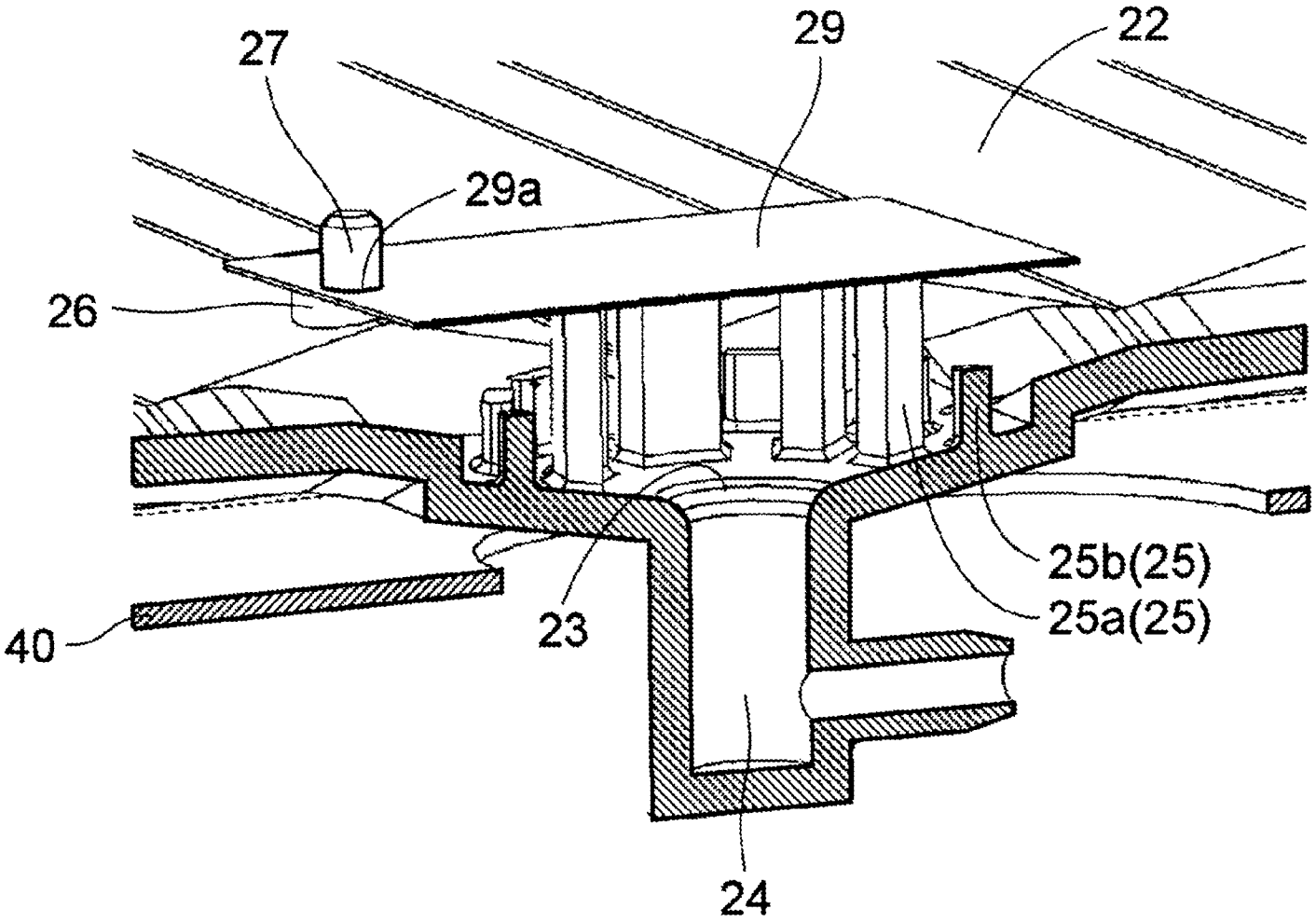
FIG. 20 illustrates a structure in the peripheral area of the discharge port of the collecting tray of the wipe unit according to the one embodiment.

As illustrated in FIGS. 17 and 18, a discharge port 23 that discharges the collected ink downward is located in the center of the groove 21. As illustrated in FIGS. 19 and 20, the discharge port 23 is coupled to an ink discharge path 24 through which the ink passes. The ink discharge path 24 has a downstream end to which an upstream end of a discharge tube 91 is connected. The discharge tube 91 includes a pump 92 that suctions the ink. The discharge tube 91 has a downstream end at which the waste ink tank (waste ink container) 93 that accumulates the ink is located.

The groove 21 has a bottom surface 21*a* that is formed to incline downward toward the discharge port 23. The ink wiped off from the ink discharge surfaces F with the wipers 35*a* to 35*c* and dropped onto the tray surfaces 22, after flowing on the tray surfaces 22 toward the groove 21, flows in the groove 21 toward the discharge port 23. Then, the ink is suctioned by the pump 92, passes through the discharge tube 91, and is accumulated in the waste ink tank 93.

The groove 21 includes two screw stop portions 21*b* in cylindrical shapes. The screw stop portion 21*b* is secured to the support frame 40 with a screw 28. The screw stop portion 21*b* has an upper portion on which a lid portion 21*c* for preventing the ink from dropping into the screw stop portion 21*b* is located.

Here, in this embodiment, as illustrated in FIG. 18, the collecting tray 44 has a top surface on which a plurality of ribs 25 are located with a predetermined interval from one another in a circumferential direction of the discharge port 23 so as to surround a peripheral area of the discharge port 23. The ribs 25 are formed so as to project upward from the top surface of the collecting tray 44.

The ribs 25 include a plurality of inner ribs 25*a* and a plurality of outer ribs 25*b*. The plurality of inner ribs 25*a* are arranged in a peripheral area of the discharge port 23 so as to form a circular shape with a predetermined interval from one another in the circumferential direction. The plurality of outer ribs 25*b* are arranged outside the inner ribs 25*a* so as to form a circular shape with a predetermined interval from one another in the circumferential direction.

Figure 21:
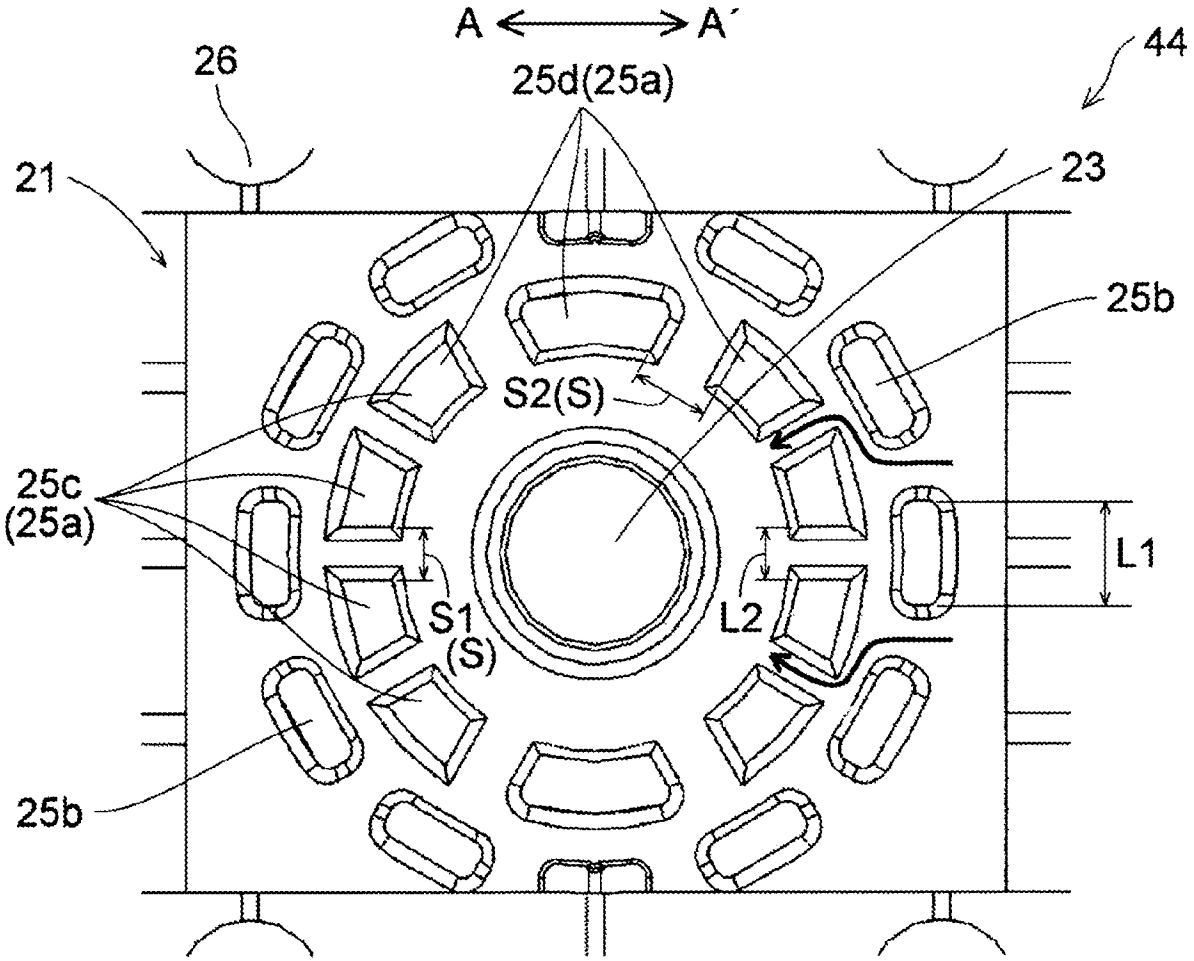
FIG. 21 illustrates a structure in the peripheral area of the discharge port of the collecting tray of the wipe unit according to the one embodiment from above.

As illustrated in FIG. 21, the inner ribs 25*a* and the outer ribs 25*b* are arranged alternately in the circumferential direction. In other words, the inner ribs 25*a* are arranged so as to oppose clearances between the adjacent outer ribs 25*b*, and the outer ribs 25*b* are arranged so as to oppose clearances between the adjacent inner ribs 25*a*. In view of this, the ink that has passed through the clearances between the outer ribs 25*b* collides against the inner ribs 25*a*. That is, the ink does not flow in a straight line to reach the discharge port 23, but meanders to reach the discharge port 23. The outer rib 25*b* has a length L1 in a longitudinal direction (circumferential direction) that is formed larger than a distance L2 between the inner ribs 25*a*.

The inner ribs 25*a* include a plurality of first ribs 25*c* and a plurality of second ribs 25*d*. The plurality of first ribs 25*c* are located in the direction of the arrow AA' with respect to the discharge port 23. The plurality of second ribs 25*d* are located in the direction of the arrow BB' with respect to the discharge port 23. A part of the inner ribs 25*a* doubles as the first rib 25*c* and the second rib 25*d*. A first clearance S1 between the first ribs 25*c* is smaller than a second clearance S2 between the second ribs 25*d*.

In other words, between the inner ribs 25*a* adjacent in the circumferential direction, a clearance S is formed. A plurality of the clearances S include a plurality of the first clearances S1 and a plurality of the second clearances S2. The plurality of first clearances S1 are located in the direction of the arrow AA' with respect to the discharge port 23. The plurality of second clearances S2 are located in the direction of the arrow BB' with respect to the discharge port 23. The first clearance S1 is smaller than the second clearance S2.

As illustrated in FIG. 20, the inner ribs 25*a* have top surfaces on which a cover member 29 that covers a region surrounded by the plurality of ribs 25 is located. The cover member 29 is formed of a rectangular-shaped sheet made of crystalline resin such as PET.

As illustrated in FIG. 18, the tray surfaces 22 include four column-shaped supporting portions 26 and two positioning protrusions 27. The supporting portions 26 support the cover member 29. The positioning protrusions 27 are for positioning the cover member 29. In this embodiment, the positioning protrusions 27 are located on top surfaces of a part (two) of the supporting portions 26. The top surface of the supporting portion 26 is arranged at a height position identical to that of the top surface of the inner rib 25*a*.

As illustrated in FIG. 20, the cover member 29 has two insertion holes 29*a* formed at positions corresponding to the positioning protrusions 27. The cover member 29 is placed on the top surfaces of the inner ribs 25*a* and the top surfaces of the supporting portions 26 with the positioning protrusions 27 inserted into the insertion holes 29*a*. The positioning protrusion 27 has an upper end to which a retaining member (not illustrated) that prevents the cover member 29 from moving upward is secured.

Next, a description will be given of the recovery operation of the recording heads 17*a* to 17*c* in the printer 100 of the embodiment. The recovery operation and the capping operation described below are executed by controlling operations of, for example, the recording heads 17*a* to 17*c*, the wipe unit 19, the unit elevating mechanism 60, the unit horizontal move mechanism 85, the conveyance elevating mechanism, and the respective driving sources by a control signal from the control unit 110 (see FIG. 1).

When the wipe unit 19 performs the recovery process of the recording heads 17*a* to 17*c*, the first conveyance unit 5 located facing the lower surface of the recording unit 9 (see FIG. 1) is moved down as illustrated in FIG. 7 from the state in FIG. 6. At this time, the wipe unit 19 is arranged at the first height position, and the wipe unit 19 is not coupled to the cap unit 50.

As illustrated in FIG. 11, the carriage 80 is horizontally moved from the second position to the first position with the cap unit 50 being left at the second position, and thus, the wipe unit 19 is horizontally moved from the second position to the first position while being at the first height position.

Then, the unit elevating mechanism 60 moves up the wipe unit 19 as illustrated in FIG. 12. This brings the wipers 35*a* to 35*c* of the wipe unit 19 into pressure contact with the wipe-off start positions of the ink discharge surfaces F of the recording heads 17*a* to 17*c*.

Prior to a wiping operation, the ink is supplied to the recording heads 17*a* to 17*c*. The supplied ink is forcibly extruded (purged) from the ink discharge openings 18 (see FIG. 2). This purging operation discharges ink having increased viscosity, foreign objects, and air bubbles inside the ink discharge openings 18. At this time, the purge ink is extruded to the ink discharge surfaces F along shapes of the ink discharge regions R (see FIG. 5) where the ink discharge openings 18 are.

Then, the wiping operation that wipes off the ink (purge ink) extruded to the ink discharge surfaces F is performed. Specifically, rotating the wiper carriage moving motor 45 in a normal direction from the state illustrated in FIG. 12 horizontally moves the wiper carriage 31 in the direction of the arrow B as illustrated in FIG. 13 to cause the wipers 35*a* to 35*c* to wipe off the ink extruded to the ink discharge surfaces F of the recording heads 17*a* to 17*c*. The waste ink wiped off with the wipers 35*a* to 35*c* is collected by the collecting tray 44 arranged in the wipe unit 19.

Then, the unit elevating mechanism 60 (see FIG. 14) moving down the wipe unit 19 to the first height position as illustrated in FIG. 11 separates the wipers 35*a* to 35*c* downward from the ink discharge surfaces F of the recording heads 17*a* to 17*c*. Then, the wiper carriage 31 is moved in a direction (direction of arrow B') opposite to the wiping direction to return the wipe unit 19 in an original state.

The carriage 80 and the wipe unit 19 arranged at the first position are horizontally moved from the first position to the second position. This arranges the wipe unit 19 under the cap unit 50. Thus, the recovery operation of the recording heads 17*a* to 17*c* is terminated.

The ink dropped onto the tray surfaces 22 of the collecting tray 44, after flowing on the tray surfaces 22 toward the groove 21, flows in the groove 21 toward the discharge port 23. The ink passes through the clearances between the ribs 25 to reach the discharge port 23, and the suction of the pump 92 causes the ink to pass through the discharge tube 91 and to be accumulated in the waste ink tank 93.

Next, a description will be given of an operation (capping operation) to mount the cap unit 50 to the recording heads 17*a* to 17*c* in the printer 100 of the embodiment.

When the cap unit 50 caps the recording heads 17*a* to 17*c*, the first conveyance unit 5 located facing the lower surface of the recording unit 9 (see FIG. 1) is moved down as illustrated in FIG. 7 from the state in FIG. 6. At this time, the wipe unit 19 is arranged at the first height position, and the wipe unit 19 is not coupled to the cap unit 50.

Then, the unit elevating mechanism 60 (see FIG. 14) moves up the wipe unit 19 from the first height position to the second height position. In view of this, the coupling pins 42 are inserted into the coupling holes 52*a* as illustrated in FIG. 16, and thus, the wipe unit 19 is coupled to the cap unit 50.

Then, as illustrated in FIG. 8, the carriage 80 is horizontally moved from the second position to the first position, and thus, the cap unit 50 is horizontally moved from the second position to the first position with the cap unit 50 being coupled to the top surface of the wipe unit 19.

The unit elevating mechanism 60 moves up the wipe unit 19 and the cap unit 50 as illustrated in FIG. 9. The rotation of the winding up drive motor 64 (see FIG. 14) is stopped at the point when the cap portions 53 of the cap unit 50 are brought into a close contact with the ink discharge surfaces F of the recording heads 17*a* to 17*c*, and thus, the capping of the cap unit 50 to the recording heads 17*a* to 17*c* completes.

In this embodiment, as described above, the plurality of ribs 25, which are arranged so as to surround the peripheral area of the discharge port 23 and arranged with the predetermined interval from one another in the circumferential direction of the discharge port 23, are located on the top surface of the collecting tray 44. With this, even when foreign objects or similar object drop on the collecting tray 44, the plurality of ribs 25 can reduce the foreign objects or similar object flowing into the discharge port 23, thereby ensuring reduced clogging of the discharge port 23 due to the foreign objects or similar object. This ensures reduced overflow of the ink from the collecting tray 44.

As described above, the ribs 25 include the plurality of inner ribs 25*a* and the plurality of outer ribs 25*b* located outside the inner ribs 25*a*. With this, the inner ribs 25*a* can stop the foreign objects or similar object that has slipped through the clearances between the outer ribs 25*b*, thereby ensuring further reducing the foreign objects or similar object flowing into the discharge port 23.

As described above, the inner ribs 25*a* and the outer ribs 25*b* are arranged alternately in the circumferential direction. This ensures colliding the foreign objects or similar object that has slipped through the clearances between the outer ribs 25*b* against the inner ribs 25*a*, thereby ensuring effectively reducing the foreign objects or similar object flowing into the discharge port 23.

As described above, on the top surfaces of the inner ribs 25*a*, the cover member 29, which covers the region surrounded by the plurality of inner ribs 25*a*, is located. This ensures reducing the foreign objects or similar object directly getting into the discharge port 23 from above, thereby ensuring further reduced clogging of the discharge port 23 due to the foreign objects or similar object.

As described above, the top surfaces of the collecting tray 44 include the supporting portions 26, which support the cover member 29, and the positioning protrusions 27, which position the cover member 29. This ensures stably supporting the cover member 29 and reduced position shift of the cover member 29.

As described above, the first clearance S1 located in the direction of the arrow AA' with respect to the discharge port 23 is smaller than the second clearances S2 located in the direction of the arrow BB' with respect to the discharge port 23. On this collecting tray 44, the ink dropped on the tray surfaces 22 flows on the tray surfaces 22 toward the groove 21. Then, while a part of the ink (ink dropped in centers of the tray surfaces 22 in direction of arrow AA') passes through the second clearances S2, the most part of the ink passes through the first clearances S1 after flowing in the groove 21 in the direction of the arrow AA' toward the discharge port 23. In view of this, the most part of the foreign objects or similar object flow toward the first clearances S1. Therefore, the first clearance S1 being smaller than the second clearance S2 ensures more effectively stopping the foreign objects or similar object.

For example, while in the above-described embodiment, it has been described an example that performs the recovery operation of the recording heads 17*a* to 17*c* by using only the ink (purge ink), the recovery operation of the recording heads 17*a* to 17*c* may be performed by using the ink and a cleaning liquid.

While in the above-described embodiment, it has been described an example that locates the inner ribs 25*a* and the outer ribs 25*b* in the peripheral area of the discharge port 23, the disclosure is not limited to this. Only the inner ribs 25*a* may be located in the peripheral area of the discharge port 23. The plurality of ribs 25 may be additionally located outside the outer ribs 25*b*.

Exemplary Embodiment of the Disclosure

In order to achieve the above-described object, a wipe unit according to a first aspect of the disclosure is a wipe unit that cleans a recording head having an ink discharge surface on which an ink discharge opening that discharges an ink onto a recording medium opens. The wipe unit includes a wiper that wipes off an ink forcibly extruded from the ink discharge opening and a collecting tray that is arranged under the wiper and collects the ink wiped off with the wiper. The collecting tray includes a discharge port that discharges the collected ink downward, and a plurality of ribs arranged so as to surround a peripheral area of the discharge port and arranged with a predetermined interval from one another in a circumferential direction of the discharge port.

Effect of the Disclosure

With the wipe unit according to the first aspect of the disclosure, the collecting tray includes the plurality of ribs arranged so as to surround the peripheral area of the discharge port and arranged with the predetermined interval from one another in the circumferential direction of the discharge port. With this, even when foreign objects or similar object drop on the collecting tray, the plurality of ribs can reduce the foreign objects or similar object flowing into the discharge port, thereby ensuring reduced clogging of the discharge port due to the foreign objects or similar object. This ensures reduced overflow of the ink from the collecting tray.

While various aspects and embodiments have been disclosed herein, other aspects and embodiments will be apparent to those skilled in the art. The various aspects and embodiments disclosed herein are for purposes of illustration and are not intended to be limiting, with the true scope and spirit being indicated by the following claims.

What is claimed is:

1. A wipe unit for cleaning a recording head having an ink discharge surface on which opens an ink discharge opening for discharging ink onto a recording medium, the wipe unit comprising:

a wiper for wiping off ink forcibly extruded from the ink discharge opening; and a collecting tray arranged under the wiper, for collecting ink wiped off with the wiper, the collecting tray provided with a discharge port for discharging the collected ink downward, and with a plurality of ribs arranged peripherally surrounding the discharge port at a predetermined circumferential interval from one another; and a cover member provided on top surfaces of the plurality of ribs, for covering an area surrounded by the plurality of ribs.

2. The wipe unit according to claim 1, wherein the ribs include a plurality of inner ribs located in the peripheral area of the discharge port and a plurality of outer ribs located outside the inner ribs, the plurality of inner ribs being arranged to form a circular shape with a predetermined interval from one another in the circumferential direction, the plurality of outer ribs being arranged to form a circular shape with a predetermined interval from one another in the circumferential direction.

3. The wipe unit according to claim 2, wherein the inner ribs and the outer ribs are arranged alternately in the circumferential direction.

4. The wipe unit according to claim 1, wherein the collecting tray has a top surface on which a supporting portion and a positioning protrusion are located, the supporting portion supporting the cover member, the positioning protrusion positioning the cover member.

5. The wipe unit according to claim 1, wherein the collecting tray has a groove that extends in a first direction and a tray surface that inclines downward toward the groove, the discharge port being arranged in the groove, the groove has a bottom surface formed to incline downward toward the discharge port, a clearance is formed between the ribs adjacent in the circumferential direction, a plurality of the clearances include a first clearance located in the first direction with respect to the discharge port and a second clearance located in a second direction perpendicular to the first direction with respect to the discharge port, and the first clearance is smaller than the second clearance.

6. An ink-jet recording apparatus comprising:

the wipe unit according to claim 1;

the recording head that discharges the ink onto the recording medium; and a waste ink container that accumulates the ink discharged from the collecting tray.

* * * * *